US009592548B2

(12) United States Patent
Bewlay et al.

(10) Patent No.: US 9,592,548 B2
(45) **Date of Patent: *Mar. 14, 2017**

(54) CALCIUM HEXALUMINATE-CONTAINING MOLD AND FACECOAT COMPOSITIONS AND METHODS FOR CASTING TITANIUM AND TITANIUM ALUMINIDE ALLOYS

(71) Applicant: GENERAL ELECTRIC COMPANY, Schenectady, NY (US)

(72) Inventors: Bernard Patrick Bewlay, Niskayuna, NY (US); Michael James Weimer, Cincinnati, OH (US); Stephen Francis Bancheri, Niskayuna, NY (US); Joan McKiever, Niskayuna, NY (US); Brian Michael Ellis, Niskayuna, NY (US)

(73) Assignee: General Electric Company, Niskayuna, NY (US)

( * ) Notice: Subject to any disclaimer, the term of this patent is extended or adjusted under 35 U.S.C. 154(b) by 739 days.

This patent is subject to a terminal disclaimer.

(21) Appl. No.: 13/752,880

(22) Filed: Jan. 29, 2013

(65) Prior Publication Data

US 2014/0209268 A1 Jul. 31, 2014

(51) Int. Cl.
*B22C 1/00* (2006.01)
*B32B 1/00* (2006.01)
(Continued)

(52) U.S. Cl.
CPC ..... *B22C 1/00* (2013.01); *B22C 1/16* (2013.01); *B22C 1/18* (2013.01); *B22C 1/181* (2013.01); *B22C 3/00* (2013.01); *B22C 9/00* (2013.01); *B22C 9/02* (2013.01); *B22C 9/04* (2013.01); *B22D 21/005* (2013.01); *B22D 41/00* (2013.01);
(Continued)

(58) Field of Classification Search
CPC .... B22C 1/00; B22C 1/16; B22C 1/18; B22C 1/181; B22C 3/00; B22C 9/00; B22C 9/02; B22D 41/00; Y10T 428/131; Y10T 428/1317; B32B 1/00
See application file for complete search history.

(56) References Cited

U.S. PATENT DOCUMENTS 2,781,261 A 2/1957 Kamlet
2,837,426 A 6/1958 Kamlet
(Continued)

FOREIGN PATENT DOCUMENTS

CA 2057373 12/1991
CN 1060683 4/1992
(Continued)

OTHER PUBLICATIONS

Etsuo Sakai, et al; "Mechanical Properties and Micro-Structures of Calcium Aluminate Based Ultra High Strength Cement," Cement and Concrete Research, Jun. 2010, vol. 40, Issue 6, pp. 966-970.
(Continued)

*Primary Examiner* — Walter B Aughenbaugh
(74) *Attorney, Agent, or Firm* — Paul J. DiConza

(57) ABSTRACT

The disclosure relates generally to mold compositions and methods of molding and the articles so molded. More specifically, the disclosure relates to mold compositions, intrinsic facecoat compositions, and methods for casting titanium-containing articles, and the titanium-containing articles so molded, where the mold comprises calcium hexaluminate.

21 Claims, 3 Drawing Sheets

(51) Int. Cl.

| | |
|---|---|
| ***B22C 3/00*** | (2006.01) |
| ***B22C 1/16*** | (2006.01) |
| ***B22C 9/00*** | (2006.01) |
| ***B22D 41/00*** | (2006.01) |
| ***B22C 1/18*** | (2006.01) |
| ***B22C 9/02*** | (2006.01) |
| ***B22C 9/04*** | (2006.01) |
| ***B22D 21/00*** | (2006.01) |

(52) U.S. Cl.
CPC ..... *Y10T 428/131* (2015.01); *Y10T 428/1317* (2015.01); *Y10T 428/256* (2015.01); *Y10T 428/26* (2015.01)

(56) References Cited

U.S. PATENT DOCUMENTS 2,911,311 A 11/1959 Feagin et al.
3,084,060 A 4/1963 Baer et al.
3,180,632 A 4/1965 Katz et al.
3,269,848 A 8/1966 Miller, Jr.
3,312,558 A * 4/1967 Miller, Jr. ..... C01F 7/164 106/38.9
3,565,643 A 2/1971 Bergna
3,660,075 A 5/1972 Harbur et al.
3,676,161 A 7/1972 Yates
3,734,480 A 5/1973 Zanis et al.
3,787,143 A 1/1974 Carbonnel et al.
3,961,995 A 6/1976 Alliot et al.
3,969,195 A 7/1976 Dötzer et al.
4,028,096 A 6/1977 Banker et al.
4,040,845 A 8/1977 Richerson et al.
4,131,474 A 12/1978 Uchikawa et al.
4,148,204 A 4/1979 Dötzer et al.
4,356,152 A 10/1982 Berkman et al.
4,661,316 A 4/1987 Hashimoto et al.
4,703,806 A 11/1987 Lassow et al.
4,710,348 A 12/1987 Brupbacher et al.
4,723,764 A 2/1988 Mizuhara
4,740,246 A 4/1988 Feagin
4,746,374 A 5/1988 Froes et al.
4,793,971 A 12/1988 Eckert et al.
4,802,436 A 2/1989 Wilson et al.
4,808,372 A 2/1989 Koczak et al.
4,892,693 A 1/1990 Perrotta et al.
4,893,743 A 1/1990 Eylon et al.
4,919,886 A 4/1990 Venkataraman et al.
4,951,929 A 8/1990 Schwarz et al.
4,966,225 A 10/1990 Johnson et al.
4,996,175 A 2/1991 Sturgis
5,011,554 A 4/1991 Fleischer
5,098,484 A 3/1992 Eylon et al.
5,098,653 A 3/1992 Shyh-Chin
5,102,450 A 4/1992 Huang
5,152,853 A 10/1992 Fleischer
5,190,603 A 3/1993 Nazmy et al.
5,205,984 A 4/1993 Rowe
5,263,530 A 11/1993 Colvin
5,269,845 A 12/1993 Grunau et al.
5,284,620 A 2/1994 Larsen, Jr.
5,287,910 A 2/1994 Colvin et al.
5,296,055 A 3/1994 Matsuda
5,297,615 A 3/1994 Aimone et al.
5,299,619 A 4/1994 Chandley et al.
5,305,817 A 4/1994 Borisov et al.
5,346,184 A 9/1994 Ghosh
5,350,466 A 9/1994 Larsen, Jr. et al.
5,354,351 A 10/1994 Kampe et al.
5,366,570 A 11/1994 Mazur et al.
5,368,657 A 11/1994 Anderson et al.
5,372,663 A 12/1994 Shibue et al.
5,407,001 A 4/1995 Yasrebi et al.
5,424,027 A 6/1995 Eylon
5,427,173 A 6/1995 Das et al.
5,429,778 A 7/1995 Patel et al.
5,443,892 A 8/1995 Holcombe et al.
5,453,243 A 9/1995 Hansen et al.
5,476,679 A 12/1995 Lewis et al.
5,503,798 A 4/1996 Singheiser et al.
5,580,403 A 12/1996 Mazur et al.
5,602,197 A 2/1997 Johnson et al.
5,626,179 A 5/1997 Choudhury et al.
5,632,326 A 5/1997 Gough
5,678,298 A 10/1997 Colvin et al.
5,749,937 A 5/1998 Detering et al.
5,766,329 A 6/1998 LaSalle et al.
5,776,617 A 7/1998 Brady et al.
5,823,243 A 10/1998 Kelly
5,839,504 A 11/1998 Matsuda
5,908,516 A 6/1999 Nguyn-Dinh
5,942,057 A 8/1999 Hanamura et al.
5,944,088 A 8/1999 Feagin
5,950,706 A 9/1999 Choudhury et al.
5,981,083 A 11/1999 Colvin et al.
5,997,802 A 12/1999 Holcombe, Jr. et al.
6,136,094 A 10/2000 Yamaji et al.
6,174,387 B1 1/2001 Bellows et al.
6,174,495 B1 1/2001 Nishikiori
6,250,366 B1 6/2001 Choudhury et al.
6,283,195 B1 9/2001 Chandley et al.
6,284,389 B1 9/2001 Jones et al.
6,352,101 B1 3/2002 Ghosh et al.
6,355,362 B1 3/2002 Jones et al.
6,408,929 B2 6/2002 Choudhury et al.
6,409,963 B1 6/2002 Gohres et al.
6,425,504 B1 7/2002 Besser el al.
6,443,212 B1 9/2002 Choudhury et al.
6,488,073 B1 12/2002 Blenkinsop et al.
6,524,407 B1 2/2003 Paul et al.
6,596,963 B2 7/2003 Kelly
6,660,109 B2 12/2003 Hajaligol et al.
6,669,791 B2 12/2003 Tetsui et al.
6,705,385 B2 3/2004 Ray et al.
6,723,279 B1 4/2004 Withers et al.
6,746,508 B1 6/2004 Deevi et al.
6,755,239 B2 6/2004 Ray et al.
6,776,214 B2 8/2004 Ray et al.
6,776,219 B1 8/2004 Cornie et al.
6,799,626 B2 10/2004 Ray et al.
6,868,814 B2 3/2005 Baur et al.
6,923,934 B2 8/2005 Nishikiori
7,157,148 B2 1/2007 Takai et al.
7,173,079 B2 2/2007 Rabe et al.
7,360,579 B2 4/2008 Renkel et al.
7,389,808 B2 6/2008 Renkel et al.
7,389,809 B2 6/2008 Renkel et al.
7,632,770 B2 12/2009 Klishchat
7,761,969 B2 7/2010 Bewlay et al.
8,048,365 B2 11/2011 Bewlay et al.
8,062,581 B2 11/2011 Bewlay et al.
8,075,713 B2 12/2011 Renkel
8,136,572 B2 3/2012 Renkel
8,136,573 B2 3/2012 Renkel
8,167,023 B2 5/2012 Renkel
8,906,292 B2 * 12/2014 Bewlay ..... B22D 41/00 266/275
8,932,518 B2 * 1/2015 Bewlay ..... B22C 9/04 106/38.27
8,992,824 B2 * 3/2015 Bewlay ..... F27D 1/0006 266/276
9,192,983 B2 * 11/2015 Bewlay ..... B22C 1/00
2002/0108679 A1 8/2002 Chandley et al.
2003/0051780 A1 3/2003 Blenkinsop et al.
2004/0045644 A1 3/2004 Guther et al.
2005/0084407 A1 4/2005 Myrick
2007/0107202 A1 5/2007 Das
2007/0199676 A1 8/2007 Wolter
2007/0227404 A1 * 10/2007 Plank ..... C09K 8/16 106/694
2007/0280328 A1 12/2007 Lee et al.
2008/0003453 A1 1/2008 Ogren
2008/0156147 A1 7/2008 Kelly et al.
2008/0156453 A1 7/2008 Kelly et al.
2008/0175990 A1 7/2008 McGowan et al.

(56) References Cited

U.S. PATENT DOCUMENTS

| | | | |
|---|---|---|---|
| 2008/0260608 | A1 | 10/2008 | Rancoule |
| 2008/0290568 | A1 | 11/2008 | Bewlay et al. |
| 2009/0020253 | A1 | 1/2009 | Knevels |
| 2009/0050284 | A1 | 2/2009 | Seserko |
| 2009/0133850 | A1 | 5/2009 | Kelly et al. |
| 2009/0169415 | A1 | 7/2009 | Chikugo et al. |
| 2009/0321038 | A1 | 12/2009 | Renkel |
| 2010/0089500 | A1 | 4/2010 | Renkel |
| 2011/0091324 | A1 | 4/2011 | Holzschuh |
| 2011/0094705 | A1 | 4/2011 | Kelly et al. |
| 2011/0203761 | A1 | 8/2011 | Renkel |
| 2013/0000862 | A1 | 1/2013 | Cretegny et al. |

FOREIGN PATENT DOCUMENTS

| | | | |
|---|---|---|---|
| CN | 1121328 | A | 4/1996 |
| CN | 101349619 | A | 1/2009 |
| CN | 101829770 | | 9/2010 |
| DE | 19752777 | A1 | 7/1999 |
| DE | 10125129 | A1 | 1/2003 |
| DE | 102009027019 | A1 | 11/2010 |
| EP | 0096985 | A1 | 12/1983 |
| EP | 0238758 | A2 | 9/1987 |
| EP | 0529594 | A1 | 3/1993 |
| EP | 0530968 | A1 | 3/1993 |
| EP | 0560070 | A1 | 9/1993 |
| EP | 0753593 | A1 | 1/1997 |
| EP | 1061149 | A1 | 12/2000 |
| EP | 1178023 | A1 | 2/2002 |
| EP | 1797977 | A2 | 6/2007 |
| GB | 569852 | | 6/1945 |
| GB | 783411 | A | 9/1957 |
| GB | 2248071 | A | 3/1992 |
| GB | 2372038 | A | 8/2002 |
| GB | 2440334 | A | 1/2008 |
| JP | 54157780 | | 12/1979 |
| JP | 6368239 | A | 3/1988 |
| JP | 01139988 | A | 6/1989 |
| JP | 01184392 | A | 7/1989 |
| JP | 03282187 | A | 12/1991 |
| JP | 0499840 | A | 3/1992 |
| JP | 06009290 | | 1/1994 |
| JP | 06179930 | | 6/1994 |
| JP | 06269927 | A | 9/1994 |
| JP | 0789789 | A | 4/1995 |
| JP | 10204555 | A | 8/1998 |
| JP | 11116399 | A | 4/1999 |
| JP | 2001208481 | A | 8/2001 |
| JP | 2003056988 | A | 2/2003 |
| JP | 200560203 | A | 3/2005 |
| JP | 4334973 | B2 | 9/2009 |
| JP | 4527656 | B2 | 8/2010 |
| WO | WO8606366 | A1 | 11/1986 |
| WO | WO8803520 | A1 | 5/1988 |
| WO | WO8910982 | A1 | 11/1989 |
| WO | WO9013377 | A1 | 11/1990 |
| WO | WO9630552 | A1 | 10/1996 |
| WO | WO9832557 | A1 | 7/1998 |
| WO | WO9927146 | A1 | 6/1999 |
| WO | WO0044959 | A1 | 8/2000 |
| WO | WO0067541 | A1 | 11/2000 |
| WO | WO2008049452 | A1 | 5/2008 |
| WO | WO2011048423 | A1 | 4/2011 |

OTHER PUBLICATIONS

M. Fuhrer, et al.; "Microstructural Evolution in Self-Forming Spinel/Calciumaluminate-Bonded Castable Refractories," Journal of the European Ceramic Society, 1998, vol. 18, Issue 7, pp. 813-820.

Chang et al., "Design of Moulds for Light Industry", China Die & Mould Design Canon, vol. No. 2, pp. 1597-1602, Jan. 31, 2003.

Henglong et al., "First Volume of Aluminium Smelting and Production Technology Manual", Metallurgical Industry Press, pp. 959-969, Jul. 31, 2011.

Unofficial English Translation of Chinese Office Action issued in connection with corresponding CN Application No. 201480006557.4 on Apr. 15, 2016.

Partial International Search Report issued in corresponding PCT application PCT/US2014/012301dated Jun. 3, 2104.

Parker, K. et al., "Refractory Calcium Aluminate Cements", British Ceramic Chemical Society. Transactions and Journal, Maney Publishing, GB, vol. 81, Jan. 1, 1982 pp. 35-42.

Li Youqin, et al, "Titanium Plate Stamp Forming Technology", National Defence Industry Press, pp. 159-160, 1986.

Unofficial English Translation of Chinese Office Action issued in connection with corresponding CN Application No. 201480006557.4 on Oct. 11, 2016.

* cited by examiner

200

| | |
|---|---|
| Obtaining an investment casting mold composition comprising calcium hexaluminate, calcium aluminate cement, and aluminum oxide, the investment casting mold composition being produced by: (i) combining calcium hexaluminate and calcium aluminate cement with a liquid to produce an initial slurry of a calcium hexaluminate-calcium aluminate cement mixture having a percentage of solids of about 65% to about 80% and (ii) adding large-scale aluminum oxide particles into the initial slurry to yield a final slurry comprising the calcium hexaluminate-calcium aluminate cement mixture with the large-scale aluminum oxide particles such that the percentage of solids in the final slurry is about 75% to about 95% | 210 |
| Pouring the investment casting mold composition into a vessel containing a fugitive pattern | 220 |
| Curing the investment casting mold composition | 230 |
| Removing the fugitive pattern from the mold | 240 |
| Firing the mold | 250 |
| Preheating the mold to a mold casting temperature | 260 |
| Pouring molten titanium or titanium alloy into the heated mold | 270 |
| Solidifying the molten titanium or titanium alloy and forming a solidified titanium or titanium alloy casting | 280 |
| Removing the solidified titanium or titanium alloy casting from the mold | 290 |

FIG. 4

CALCIUM HEXALUMINATE-CONTAINING MOLD AND FACECOAT COMPOSITIONS AND METHODS FOR CASTING TITANIUM AND TITANIUM ALUMINIDE ALLOYS

BACKGROUND

Modern gas or combustion turbines must satisfy the highest demands with respect to reliability, weight, power, economy, and operating service life. In the development of such turbines, the material selection, the search for new suitable materials, as well as the search for new production methods, among other things, play a role in meeting standards and satisfying the demand.

The materials used for gas turbines may include titanium alloys, nickel alloys (also called super alloys) and high strength steels. For aircraft engines, titanium alloys are generally used for compressor parts, nickel alloys are suitable for the hot parts of the aircraft engine, and the high strength steels are used, for example, for compressor housings and turbine housings. The highly loaded or stressed gas turbine components, such as components for a compressor for example, are typically forged parts. Components for a turbine, on the other hand, are typically embodied as investment cast parts.

Although investment casting is not a new process, the investment casting market continues to grow as the demand for more intricate and complicated parts increases. Because of the great demand for high quality, precision castings, there continuously remains a need to develop new ways to make investment castings more quickly, efficiently, cheaply and of higher quality.

Conventional investment mold compounds that consist of fused silica, cristobalite, gypsum, or the like, that are used in casting jewelry and dental prostheses industries are generally not suitable for casting reactive alloys, such as titanium alloys. One reason is because there is a reaction between mold titanium and the investment mold.

There is a need for a simple investment mold that does not react significantly with titanium and titanium aluminide alloys. Approaches have been adopted previously with ceramic shell molds for titanium alloy castings. In the prior examples, in order to reduce the limitations of the conventional investment mold compounds, several additional mold materials have been developed. For example, an investment compound was developed of an oxidation-expansion type in which magnesium oxide or zirconia was used as a main component and metallic zirconium was added to the main constituent to compensate for the shrinkage due to solidification of the cast metal. There is thus also a need for simple and reliable investment casting methods which allow easy extraction of near-net-shape metal or metal alloys from an investment mold that does not react significantly with the metal or metal alloy.

Certain references describe using calcium hexaluminate and calcium aluminate cement have been disclosed. For example, references such as U.S. Pat. Nos. 3,269,848 and 3,312,558 to Miller disclose the production of calcium hexaluminate and the production of shapes of calcium hexaluminate and calcium aluminate cement, including slip casting molds. However, such references do not disclose the use of calcium hexaluminate as a component of a casting mold for reactive alloy articles and certain complex articles such as turbine components.

Other references, such as European Patent Application No. 1178023 A1 to Gnauck et al., disclose a high density refractory material containing calcium hexaluminate produced by combining a mixture of aluminum oxide with calcium oxide and a sintering aid. The calcium hexaluminate is produced to have a bulk specific density greater than 90 percent. However, these references do not disclose the use of calcium hexaluminate as a component of a casting mold for reactive alloy articles and turbine components.

Other references, such as U.S. Patent Application No. US 2008/0175990 to McGowan et al., disclose the use of calcium hexaluminate with calcium aluminate cement. Such references describe methods that involve the use of calcium hexaluminate for improving the insulating character and/or penetration resistance of a liner in contact with at least one of an alkali environment and/or alkaline environment. This method comprises lining a surface that is subject to wear by an alkali environment and/or an alkaline environment with a refractory composition comprising a refractory aggregate consisting essentially of a calcium hexaluminate clinker, and wherein the hexaluminate clinker has from zero to less than about fifty weight percent mayenite. Such references also describes methods for making articles of stable calcium hexaluminate by starting with alpha alumina and calcium oxide. The articles so produced can also possess burnout material such that the shapes produced have porosity between 50% and 70%. The examples disclosed in the references involve the use of calcium aluminate cement in conjunction with calcium hexaluminate, but at very low concentrations of calcium aluminate cement. For example, the references describe the weight concentration of calcium aluminate cement to calcium hexaluminate to range from 1:4 to 1:14.

SUMMARY

Aspects of the present disclosure provide casting mold compositions, methods of casting, and cast articles that overcome the limitations of the conventional techniques. Though some aspect of the disclosure may be directed toward the fabrication of components for the aerospace industry, for example, engine turbine blades, aspects of the present disclosure may be employed in the fabrication of any component in any industry, in particular, those components containing titanium and/or titanium alloys.

One aspect of the present disclosure is a mold for casting a titanium-containing article, comprising: (i) a bulk comprising calcium hexaluminate and a calcium aluminate cement, the calcium aluminate cement comprising calcium monoaluminate, calcium dialuminate, and mayenite; and (ii) a cavity for casting titanium-containing articles. In one embodiment, the mold further comprises an intrinsic facecoat of about 10 microns to about 500 microns between the bulk of the mold and the mold cavity. In various embodiments, the weight concentration ratios in the mold of calcium aluminate cement to calcium hexaluminate ranges from 1.3:1 to 1:2.

As used herein, the term "intrinsic facecoat" refers to a facecoat of the mold that can contain at least one component in common with the bulk mold formulation. By way of contrast, the term "extrinsic facecoat" refers to a facecoat that contains a component that is not part of the parent bulk formulation. An intrinsic facecoat of the mold can be continuous, substantially continuous, or non-continuous.

In general, the mold includes at least calcium hexaluminate and a calcium aluminate cement, both of which are described herein. The calcium hexaluminate functions as an inert, passive, filler-like constituent, while the calcium aluminate cement functions as an active, hydraulic bond forming constituent that reacts with water and provides mold strength. One advantage of the mold of the present disclosure is that its shrinkage is relatively low compared to other mold compositions. For example, in various embodiments of the mold of the present disclosure, shrinkage is less than 2%, more particularly less than 1%, and further more particularly less than 0.5%. Minimal shrinkage is particularly important in applications involving components where precise dimensional control of the component is desired. For example, in high performance components such as turbine blades for use in an aircraft engine, a mold composition having minimal shrinkage is preferred.

Further, in various embodiments, relatively low amounts of silica (e.g., less than 2% by weight) can be used in the molds of the present disclosure.

In one embodiment, the calcium hexaluminate comprises particles that are less than about 50 microns in outside dimension. In another embodiment, the calcium hexaluminate comprises from about 15 percent by weight to about 50 percent by weight of the mold. In another embodiment, the facecoat is a continuous intrinsic facecoat. In one embodiment, the mold as recited further comprises silica, for example, colloidal silica.

The mold, in one example, comprises the bulk of the mold and an intrinsic facecoat, with the bulk of the mold and the intrinsic facecoat having different compositions, and the intrinsic facecoat comprising calcium aluminate cement with a particle size of less than about 50 microns. In another embodiment, the mold comprises the bulk of the mold and an intrinsic facecoat, wherein the bulk of the mold and the intrinsic facecoat have different compositions and wherein the bulk of the mold comprises alumina particles larger than about 50 microns. The mold, in another example, comprises the bulk of the mold and an intrinsic facecoat, wherein the bulk of the mold comprises alumina particles larger than about 50 microns and the intrinsic facecoat comprises calcium aluminate cement particles less than about 50 microns in size.

In certain embodiments, the intrinsic facecoat has, by weight fraction, at least 20 percent more calcium monoaluminate than does the bulk of the mold. In one embodiment, the intrinsic facecoat has, by weight fraction, at least 20 percent less alumina than does the bulk of the mold. In another embodiment, the intrinsic facecoat has, by weight fraction, at least 20 percent more calcium monoaluminate, at least 20 percent less alumina, and at least 50 percent less mayenite than does the bulk of the mold.

The weight fraction of calcium monoaluminate in the intrinsic facecoat is, in one example, more than 0.30 and the weight fraction of mayenite is less than 0.10. In one embodiment, the calcium hexaluminate in the bulk of the mold comprises a weight fraction of about 0.01 to 0.30, and the calcium hexaluminate in the intrinsic facecoat is about 0.01 to 0.20. In one embodiment, the calcium monoaluminate in the bulk of the mold comprises a weight fraction of about 0.05 to 0.95, and the calcium monoaluminate in the intrinsic facecoat is about 0.30 to 0.95. In another embodiment, the calcium dialuminate in the bulk of the mold comprises a weight fraction of about 0.05 to about 0.80, and the calcium dialuminate in the intrinsic facecoat is about 0.05 to 0.30. In yet another embodiment, the mayenite in the bulk of the mold composition comprises a weight fraction of about 0.01 to about 0.30, and the mayenite in the intrinsic facecoat is about 0.01 to 0.05. In a particular embodiment, the calcium hexaluminate in the bulk of the mold comprises a weight fraction of about 0.01 to 0.30, and the calcium hexaluminate in the intrinsic facecoat is about 0.01 to 0.20; the calcium monoaluminate in the bulk of the mold comprises a weight fraction of about 0.05 to 0.95, and the calcium monoaluminate in the intrinsic facecoat is about 0.30 to 0.95; the calcium dialuminate in the bulk of the mold comprises a weight fraction of about 0.05 to about 0.80, and the calcium dialuminate in the intrinsic facecoat is about 0.05 to 0.30; and wherein the mayenite in the bulk of the mold composition comprises a weight fraction of about 0.01 to about 0.30, and the mayenite in the intrinsic facecoat is about 0.01 to 0.05.

In one example, the mold further comprises aluminum oxide particles in the bulk of the mold that are less than about 500 microns in outside dimension. In one example, the aluminum oxide particles comprise from about 35% by weight to about 70% by weight of the composition used to make the mold. These aluminum oxide particles may be hollow in certain examples. In another embodiment, the calcium aluminate cement comprises more than 30% by weight of the composition used to make the mold. In one embodiment, the mold further comprises more than about 10% by weight and less than about 50% by weight of the mold composition in calcium oxide.

In one example, the mold further comprises aluminum oxide particles, magnesium oxide particles, calcium oxide particles, zirconium oxide particles, titanium oxide particles, silicon oxide particles, or compositions thereof.

The percentage of solids in an initial calcium hexaluminate-calcium aluminate cement liquid mixture used to make the mold is, in one example, from about 65% to about 80%. In another example, the percentage of solids in a final calcium hexaluminate-calcium aluminate cement liquid mixture with the large scale alumina (such as >50 microns), used to make the mold, is from about 75% to about 95%. In one embodiment, a pre-initial calcium hexaluminate-calcium aluminate cement liquid mixture can be used prior to making the initial calcium hexaluminate-calcium aluminate cement liquid mixture, with the pre-initial calcium hexaluminate-calcium aluminate cement liquid mixture having a percentage of solids of from about 41% to about 65%.

In one embodiment, the mold composition based on its initial constituents can include, without limitation, the following: (i) silica in the amount of less than 2 percent by weight, and in a more particular embodiment less than 1 percent by weight; (ii) calcium aluminate cement in an amount of between about 20-65% by weight; (iii) calcium hexaluminate in an amount of between about 15-50% by weight; and (iv) large-scale alumina in an amount of between about 25-40% by weight. In another embodiment, the mold composition based on its initial constituents can include, without limitation, silicates in an amount of less than about 5% by weight. Examples of suitable silicates for use in the mold composition can include, without limitation, aluminosilicates, calcium aluminosilicates, and the like.

One aspect of the present disclosure is a titanium-containing article formed in the mold disclosed herein. The article, in one example, comprises a titanium aluminide-containing turbine blade. In one aspect, the present disclosure is the mold as disclosed herein, wherein the mold forms a titanium-containing article. In one related embodiment, the titanium-containing article comprises a titanium aluminide-containing turbine blade.

One aspect of the present disclosure is a facecoat composition of a mold that is used for casting a titanium-containing article, the facecoat composition comprising: calcium hexaluminate, calcium monoaluminate, calcium dialuminate, and mayenite, wherein the facecoat composition is an intrinsic facecoat, is about 10 microns to about 500 microns thick, and is located between the bulk of the mold and the surface of the mold that opens to the mold cavity. In one embodiment, the calcium hexaluminate comprises particles that are less than about 50 microns in outside dimension. The facecoat comprises, in one example, of calcium aluminate with a particle size of less than about 50 microns. In one embodiment, the facecoat composition further comprises silica, for example, colloidal silica.

In one embodiment, the intrinsic facecoat has, by weight fraction, at least 20 percent more calcium aluminate, at least 20 percent less alumina, and at least 50 percent less mayenite than does the bulk of the mold. The weight fraction of calcium monoaluminate in the intrinsic facecoat is, in one example, more than 0.30 and the weight fraction of mayenite is less than 0.10. In one embodiment, the calcium hexaluminate in the intrinsic facecoat comprises a weight fraction of 0.01 to 0.20; the calcium monoaluminate in the intrinsic facecoat comprises a weight fraction of 0.30 to 0.95; the calcium dialuminate in the intrinsic facecoat comprises a weight fraction of 0.05 to 0.30; and the mayenite in the intrinsic facecoat comprises a weight fraction of 0.01 to 0.05.

One aspect of the present disclosure is a method for forming a casting mold for casting a titanium-containing article, the method comprising: (a) providing an initial slurry of a calcium hexaluminate-calcium aluminate cement mixture, wherein the percentage of solids in the initial slurry is about 65% to about 80% and the viscosity of the initial slurry is about 30 to about 300 centipoise; (b) adding large-scale oxide particles (such as >50 microns) into the initial slurry to yield a final slurry comprising the calcium hexaluminate-calcium aluminate cement mixture with the large-scale oxide particles such that the percentage of solids in the final slurry is about 75% to about 95%; (c) introducing the final slurry into a mold cavity that contains a fugitive pattern; and (d) allowing the final slurry to cure in the mold cavity to form a mold for casting a titanium-containing article.

One aspect of the present disclosure is a casting method for titanium and titanium alloys comprising: obtaining an investment casting mold composition comprising calcium hexaluminate, calcium aluminate, and aluminum oxide, wherein the calcium hexaluminate and calcium aluminate are combined with a liquid to produce a slurry of calcium hexaluminate-calcium aluminate, and wherein the solids in the final calcium hexaluminate-calcium aluminate/liquid mixture with the large scale alumina is about 75% to about 95%, and wherein the resulting mold has an intrinsic facecoat; pouring the investment casting mold composition into a vessel containing a fugitive pattern; curing the investment casting mold composition; removing the fugitive pattern from the mold; firing the mold; preheating the mold to a mold casting temperature; pouring molten titanium or titanium alloy into the heated mold; solidifying the molten titanium or titanium alloy and forming a solidified titanium or titanium alloy casting; and removing the solidified titanium or titanium alloy casting from the mold. In one embodiment, a titanium or titanium alloy article is claimed that is made by the casting method as taught herein.

One aspect of the present disclosure is a mold composition for casting a titanium-containing article, comprising: calcium hexaluminate and a calcium aluminate cement comprising calcium monoaluminate, calcium dialuminate, and mayenite. In one embodiment, the mold composition further comprises hollow particles of aluminum oxide. Another aspect of the present disclosure is a titanium-containing article casting-mold composition comprising calcium hexaluminate and calcium aluminate cement (including calcium monoaluminate, calcium dialuminate, and mayenite). For instance, an aspect of the present disclosure may be uniquely suited to providing mold compositions to be used in molds for casting titanium-containing and/or titanium alloy-containing articles or components, for example, titanium containing turbine blades.

These and other aspects, features, and advantages of this disclosure will become apparent from the following detailed description of the various aspects of the disclosure taken in conjunction with the accompanying drawings.

BRIEF DESCRIPTION OF THE FIGURES

The subject matter, which is regarded as the invention, is particularly pointed out and distinctly claimed in the claims at the conclusion of the specification. The foregoing and other features and advantages of the disclosure will be readily understood from the following detailed description of aspects of the invention taken in conjunction with the accompanying drawings in which:

FIG. 4 shows a flow chart, in accordance with aspects of the disclosure, illustrating a casting method for titanium and titanium alloys.

DETAILED DESCRIPTION

Figure 1:
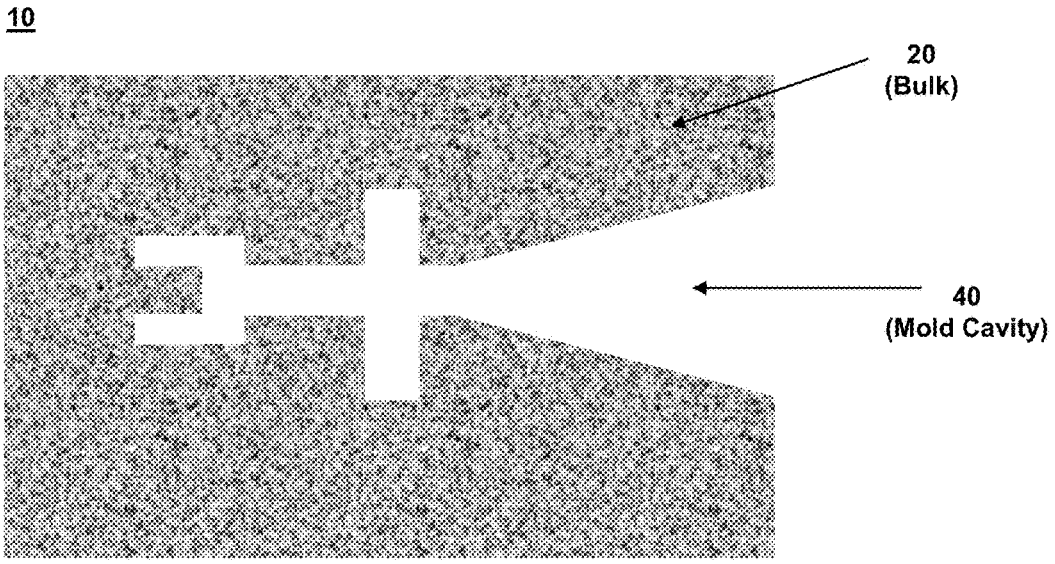
FIG. 1 is a schematic of one embodiment of a mold of the present disclosure. The mold is shown as having a bulk and a cavity.

The present disclosure relates generally to mold compositions and methods of mold making and articles cast from the molds, and, more specifically, to mold compositions and methods for casting titanium-containing articles, and titanium-containing articles so molded.

The manufacture of titanium based components by investment casting of titanium and its alloys in investment shell molds poses problems from the standpoint that the castings should be cast to "near-net-shape." That is, the components may be cast to substantially the final desired dimensions of the component, and require little or no final treatment or machining. For example, some conventional castings may require only a chemical milling or polishing to improve the surface finish of the casting. However, any sub-surface ceramic inclusions located below the surface of the casting are typically not removed by the chemical milling operation and may be formed due to the reaction between the mold facecoat and any reactive metal in the mold, for example, reactive titanium aluminide.

Conventional investment mold compounds that consist of fused silica, cristobalite, gypsum, or the like, that are used in casting jewelry and dental prostheses are not suitable for casting reactive alloys, such as titanium alloys, because there is reaction between titanium and the investment mold. Any reaction between the molten alloy and the mold will deteriorate the properties of the final casting. The deterioration can be as simple as poor surface finish due to gas bubbles, or in more serious cases, the chemistry, microstructure, and properties of the casting can be compromised.

The challenge has been to produce an investment mold that does not react significantly with titanium and titanium aluminide alloys. In this regard, few if any prior poured ceramic investment compounds exist that meet the requirements for structural titanium and titanium aluminide alloys. There is a need for an investment mold that does not react significantly with titanium and titanium aluminide alloys. In prior approaches, in order to reduce the limitations of the conventional investment mold compounds, several additional mold materials were developed. For example, an investment compound was developed of an oxidation-expansion type in which magnesium oxide or zirconia was used as a main component and metallic zirconium was added to the main constituent to compensate for the shrinkage due to solidification of the cast metal.

However, prior investment compounds have limitations. For example, the investment mold compound that is intended to compensate for the shrinkage due to the solidification of the cast metal by the oxidation-expansion of metallic zirconium is difficult to practice, for several reasons. First, a wax pattern is coated on its surface with the new investment compound with zirconium and then the coated wax pattern is embedded in the conventional investment compound in an attempt to make the required amount of zirconium as small as possible; coating the wax with zirconium is very difficult and not highly repeatable. Second, waxes of complex shaped components cannot be coated in a sufficiently uniform manner. In addition, the coated layer can come off the wax when the investment mold mix is placed externally around the coated layer and the pattern, with the result that titanium reacts with the externally placed investment mold mix.

The present disclosure provides a new approach for casting near-net-shape titanium and titanium aluminide components, such as, turbine blades or airfoils. Embodiments of the present disclosure provide compositions of matter for investment casting molds and casting methods that provide improved titanium and titanium alloy components for example, for use in the aerospace, industrial and marine industry. In some aspects, the mold composition provides a mold that contains phases that provide improved mold strength during mold making and/or increased resistance to reaction with the casting metal during casting. The molds according to aspects of the disclosure may be capable of casting at high pressure, which is desirable for near-net-shape casting methods. Mold compositions, for example, containing calcium aluminate cement, alumina particles, calcium hexaluminate, and preferred constituent phases, have been identified that provide castings with improved properties.

In one aspect, the constituent phases of the mold comprises calcium hexaluminate ($CaO.6Al_2O_3$, also referred to as "CA6") and calcium monoaluminate. The present inventors found the combination of calcium hexaluminate and calcium monoaluminate desirable for various reasons. One benefit of calcium hexaluminate is that it reduces the amount of free alumina in mold formulations that contain alumina and increases the reaction resistance of the mold. With regard to calcium monoaluminate, it is understood by the inventors that calcium monoaluminate promotes hydraulic bond formation between the cement particles during the initial stages of mold making, and this hydraulic bonding is believed to provide mold strength during mold construction. It is also understood by the inventors that calcium monoaluminate experiences a very low rate of reaction with titanium and titanium aluminide based alloys. In a certain embodiment, calcium monoaluminate is provided to the mold composition of the present disclosure, for example, the investment molds, in the form of calcium aluminate cement (e.g., including, without limitation, calcium monoaluminate, calcium dialuminate, and mayenite). In one aspect, the mold composition comprises a mixture of calcium aluminate cement and alumina, that is, aluminum oxide. In various embodiments, the weight concentration ratios in the mold of calcium aluminate cement to calcium hexaluminate ranges from 1.3 to 0.5.

As used herein, the compounds "calcium hexaluminate," "calcium monoaluminate," "calcium dialuminate," and "mayenite" are used in their broadest sense to include all chemical forms of these compounds. For example, while calcium hexaluminate is also referred to as $CaO.6Al_2O_3$ (also abbreviated as "CA6"), calcium monoaluminate is also referred to as $CaAl_2O_4$, calcium dialuminate is also referred to as $CaAl_4O_7$, and mayenite is also referred to as $Ca_{12}Al_{14}O_{33}$. The present disclosure contemplates these compounds to include other chemical forms or derivatives of these compounds, even if they include impurities at levels that do not alter the functional characteristics of these compounds.

In one aspect of the disclosure, the mold composition provides minimum reaction with the alloy during casting, and the mold provides castings with the required component properties. As used herein, the term "minimum reaction" refers to reactions whereby the pickup of total interstitial compounds such as carbon, oxygen, and hydrogen is less than about 2,000 ppm. External properties of the casting include features such as shape, geometry, and surface finish. Internal properties of the casting include mechanical properties, microstructure, and defects (such as pores and inclusions) below a specified size and within allowable limits.

In one embodiment, the mold contains a continuous intrinsic facecoat between the bulk of the mold and the mold cavity. In a related embodiment, the intrinsic facecoat is about 10 microns to about 500 microns. In certain instances, the facecoat comprises calcium aluminate with a particle size of less than about 50 microns. The mold composition may be such that the bulk of the mold comprises alumina particles larger than about 50 microns. In a certain embodiment, the facecoat has less alumina than the bulk of the mold, and wherein the facecoat has more calcium aluminate than the bulk of the mold.

The percentage of solids in the initial calcium hexaluminate-calcium aluminate cement liquid mix, and the solids in the final calcium hexaluminate-calcium aluminate cement liquid mix with the large scale alumina particles (such as >50 microns) are a feature of the present disclosure. In one embodiment, there can be multiple stages of mixing (e.g., a pre-initial stage, an initial stage, and a final stage), each with a different range of percentages of solids. In one example, the percentage of solids in the pre-initial calcium hexaluminate-calcium aluminate cement liquid mix is from about 41% to about 65%. In one example, the percentage of solids in the initial calcium hexaluminate-calcium aluminate cement liquid mix is from about 65% to about 80%. In another example, the solids in the final calcium hexaluminate-calcium aluminate cement liquid mix with the large scale alumina particles (such as >50 microns) is from about 75% to about 95%. The initial calcium hexaluminate-calcium aluminate cement and the fine-scale (less than 10 micron) alumina are mixed with water to provide a uniform and homogeneous slurry; the final mold mix is formed by adding large-scale (such as greater than 50 microns) alumina to the initial slurry and mixing for between 2 and 15 minutes to achieve a uniform mix.

The mold composition of one aspect of the present disclosure provides for low-cost casting of titanium aluminide (TiAl) turbine blades, for example, TiAl low pressure turbine blades. The mold composition may provide the ability to cast near-net-shape parts that require less machining and/or treatment than parts made using conventional shell molds and gravity casting. As used herein, the expression "near-net-shape" implies that the initial production of an article is close to the final (net) shape of the article, reducing the need for further treatment, such as, extensive machining and surface finishing. As used herein, the term "turbine blade" refers to both steam turbine blades and gas turbine blades.

Accordingly, the present disclosure addresses the challenges of producing a mold, for example, an investment mold, that does not react significantly with titanium and titanium aluminide alloys. In addition, according to some aspects of the disclosure, the strength and stability of the mold allow high pressure casting approaches, such as centrifugal casting. One of the technical advantages of this disclosure is that, in one aspect, the disclosure may improve the fatigue strength of net shape casting that can be generated, for example, from calcium aluminate cement, calcium hexaluminate, and alumina investment molds. The higher strength, for example, higher fatigue strength, allows lighter components to be fabricated. In addition, components having higher fatigue strength can last longer, and thus have lower life-cycle costs.

Casting Mold Composition

Aspects of the present disclosure provide a composition of matter for investment casting molds that can provide improved components of titanium and titanium alloys. In one embodiment, calcium hexaluminate is combined with calcium monoaluminate to form the mold of the present disclosure. In one aspect of the present disclosure, calcium monoaluminate can be provided in the form of calcium aluminate cement. Calcium aluminate cement may be referred to as a "cement" or "binder." In certain embodiments, calcium aluminate cement is mixed with alumina particulates to provide a castable investment mold mix. The calcium aluminate cement may be greater than about 30% by weight in the castable mold mix. In certain embodiments, the calcium aluminate cement is between about 30% and about 60% by weight in the castable mold mix. The use of greater than 30% by weight of calcium aluminate cement in the castable mold mix (casting mold composition) is a feature of the present disclosure. The selection of the appropriate calcium aluminate cement chemistry and alumina formulation are factors in the performance of the mold.

In one aspect, the mold composition, for example, the investment mold composition, may comprise a multi-phase mixture of calcium hexaluminate and calcium aluminate cement, or calcium hexaluminate, calcium aluminate cement, and alumina particles. The calcium aluminate cement may function as a binder, for example, the calcium aluminate cement binder may provide the main skeletal structure of the mold structure. The calcium aluminate cement may comprise a continuous phase in the mold and provide strength during curing, and casting. The mold composition may consist of calcium hexaluminate and calcium aluminate cement, that is, calcium hexaluminate and calcium aluminate cement may comprise substantially the only components of the mold composition, with little or no other components. In another embodiment, the mold composition may consist of calcium hexaluminate, calcium aluminate cement and alumina, that is, calcium hexaluminate, calcium aluminate cement, and alumina may comprise substantially the only components of the mold composition, with little or no other components.

In one embodiment, the present disclosure comprises a titanium-containing article casting-mold composition comprising calcium hexaluminate and calcium aluminate cement. In another embodiment, the casting-mold composition further comprises oxide particles, for example, hollow oxide particles. According to aspects of the disclosure, the oxide particles may be aluminum oxide particles, magnesium oxide particles, calcium oxide particles, zirconium oxide particles, titanium oxide particles, silicon oxide particles, combinations thereof, or compositions thereof. In one embodiment, the oxide particles may be a combination of one or more different oxide particles.

The casting-mold composition can further include aluminum oxide, for example, in the form of hollow particles, that is, particles having a hollow core or a substantially hollow core substantially surrounded by an oxide. These hollow aluminum oxide particles may comprise about 99% of aluminum oxide and have about 10 millimeter (mm) or less in outside dimension, such as, width or diameter. In one embodiment, the hollow aluminum oxide particles have about 1 millimeter (mm) or less in outside dimension, such as, width or diameter. In another embodiment, the aluminum oxide comprises particles that may have outside dimensions that range from about 10 microns (μm) to about 10,000 microns. In certain embodiments, the hollow oxide particles may comprise hollow alumina spheres (typically greater than 100 microns in diameter). The hollow alumina spheres may be incorporated into the casting-mold composition, and the hollow spheres may have a range of geometries, such as, round particles, or irregular aggregates. In certain embodiments, the alumina may include both round particles and hollow spheres. In one aspect, these geometries were found to increase the fluidity of the investment mold mixture. The enhanced fluidity may typically improve the surface finish and fidelity or accuracy of the surface features of the final casting produced from the mold.

The aluminum oxide comprises particles ranging in outside dimension from about 10 microns to about 10,000 microns. In certain embodiments, the aluminum oxide comprises particles that are less than about 500 microns in outside dimension, for example, diameter or width. The aluminum oxide may comprise from about 0.5% by weight to about 80% by weight of the casting-mold composition. Alternatively, the aluminum oxide comprises from about 40% by weight to about 60% by weight of the casting-mold composition. Alternatively, the aluminum oxide comprises from about 40% by weight to about 70% by weight of the casting-mold composition.

In one embodiment, the casting-mold composition further comprises calcium oxide. The calcium oxide may be greater than about 10% by weight and less than about 50% by weight of the casting-mold composition. In one embodiment, the calcium oxide is greater than about 30% by weight and less than about 50% by weight of the casting-mold composition. Alternatively, the calcium oxide is greater than about 25% by weight and less than about 35% by weight of the casting-mold composition. The final mold typically may have a density of less than 2 grams/cubic centimeter and strength of greater than 500 pounds per square inch (psi).

One aspect of the present disclosure is a mold for casting a titanium-containing article, comprising: calcium hexaluminate and a calcium aluminate cement comprising calcium monoaluminate, calcium dialuminate, and mayenite, wherein the mold has a facecoat (e.g., an intrinsic facecoat)

of about 10 microns to about 500 microns between the bulk of the mold and the mold cavity. In one embodiment, the calcium hexaluminate comprises particles that are less than about 50 microns in outside dimension. In another embodiment, the calcium hexaluminate comprises from about 15 percent by weight to about 50 percent by weight of the mold. In another embodiment, the facecoat is a continuous intrinsic facecoat.

In a specific embodiment, the casting-mold composition of the present disclosure comprises calcium hexaluminate and a calcium aluminate cement. The calcium aluminate cement includes at least three phases or components comprising calcium and aluminum: calcium monoaluminate ($CaAl_2O_4$), calcium dialuminate ($CaAl_4O_7$), and mayenite ($Ca_{12}Al_{14}O_{33}$). The weight fraction of calcium monoaluminate in the intrinsic facecoat may be more than 0.30 and the weight fraction of mayenite may be less than 0.10. In one embodiment, the calcium hexaluminate in the bulk of the mold comprises a weight fraction of about 0.01 to 0.30, and the calcium hexaluminate in the intrinsic facecoat is about 0.01 to 0.20. In one embodiment, the calcium monoaluminate in the bulk of the mold comprises a weight fraction of about 0.05 to 0.95, and the calcium monoaluminate in the intrinsic facecoat is about 0.30 to 0.95. In another embodiment, the calcium dialuminate in the bulk of the mold comprises a weight fraction of about 0.05 to about 0.80, and the calcium dialuminate in the intrinsic facecoat is about 0.05 to 0.30. In yet another embodiment, the mayenite in the bulk of the mold composition comprises a weight fraction of about 0.01 to about 0.30, and the mayenite in the intrinsic facecoat is about 0.01 to 0.05.

The exact composition of the bulk of the mold and the intrinsic facecoat may differ. For example, the calcium hexaluminate in the bulk of the mold comprises a weight fraction of about 0.01 to 0.30, and the calcium hexaluminate in the intrinsic facecoat is about 0.01 to 0.20; the calcium monoaluminate in the bulk of the mold comprises a weight fraction of about 0.05 to 0.95, and the calcium monoaluminate in the intrinsic facecoat is about 0.30 to 0.95; the calcium dialuminate in the bulk of the mold comprises a weight fraction of about 0.05 to about 0.80, and the calcium dialuminate in the intrinsic facecoat is about 0.05 to 0.30; and the mayenite in the bulk of the mold composition comprises a weight fraction of about 0.01 to about 0.30, and the mayenite in the intrinsic facecoat is about 0.01 to 0.05.

The weight fraction of calcium monoaluminate in the calcium aluminate cement may be more than about 0.2, and the weight fraction of mayenite in the calcium aluminate cement may be less than about 0.15. In another embodiment, the calcium aluminate cement is more than 30% by weight of the casting-mold composition. In one embodiment, the calcium aluminate cement has a particle size of about 50 microns or less.

In one embodiment, the weight fractions of these phases that are suitable in the cement of the bulk of the mold are 0.05 to 0.95 of calcium monoaluminate, 0.05 to 0.80 of calcium dialuminate, and 0.01 to 0.30 of mayenite. In one embodiment, the weight fractions of these phases in the facecoat of the mold are 0.30-0.95 of calcium monoaluminate, 0.05-0.30 of calcium dialuminate, and 0.01-0.05 of mayenite. In another embodiment, the weight fraction of calcium monoaluminate in the facecoat is more than about 0.3, and the weight fraction of mayenite is less than about 0.1. In one embodiment, the weight fraction of calcium monoaluminate in the cement of the bulk of the mold is more than about 0.2, and weight fraction of mayenite is less than about 0.15.

In one embodiment, the calcium aluminate cement has a particle size of about 50 microns or less. A particle size of less than 50 microns is preferred for several reasons. The fine particle size is believed to promote the formation of hydraulic bonds during mold mixing and curing. The fine particle size is understood to promote inter-particle sintering during firing, and this can increase the mold strength. The fine particle size is believed to improve the surface finish of the mold and the cast article produced in the mold. The calcium aluminate cement may be provided as powder, and can be used either in its intrinsic powder form, or in an agglomerated form, such as, as spray dried agglomerates. The calcium aluminate cement can also be preblended with fine-scale (for, example, less than 10 micron in size) alumina. The fine-scale alumina is believed to provide an increase in strength due to sintering during high-temperature firing. In certain instances, larger-scale alumina (that is, greater than 10 microns in size) may also be added with or without the fine-scale alumina.

The hollow alumina particles serve at least two functions: (1) they reduce the density and the weight of the mold, with minimal reduction in strength; strength levels of approximately 500 psi and above are obtained, with densities of approximately 2 g/cc and less; and (2) they reduce the elastic modulus of the mold and help to provide compliance during cool down of the mold and the component after casting. The increased compliance and crushability of the mold may reduce the tensile stresses on the component.

In certain embodiments, the mold can also contain small weight fractions of silicates, including, for example, aluminosilicates, calcium aluminosilicates, and the like. In order to minimize reaction of the mold with the casting, in particular embodiments, the sum of the weight fraction of aluminosilicates and calcium aluminosilicates in the bulk may typically be kept to less than 5% in one embodiment, less than 2% in another embodiment, and less than 1% in a further embodiment, and the weight fraction of aluminosilicates and calcium aluminosilicates in the facecoat may typically be kept to less than 0.5% in one embodiment, less than 0.2% in another embodiment, and less than 0.1% in a further embodiment.

Calcium Aluminate Cement Composition

The calcium aluminate cement used in aspects of the disclosure typically comprises three phases or components of calcium oxide and aluminum oxide: calcium monoaluminate ($CaAl_2O_4$), calcium dialuminate ($CaAl_4O_7$), and mayenite ($Ca_{12}Al_{14}O_{33}$). Calcium mono-aluminate is a hydraulic mineral typically present in calcium aluminate cement. Calcium monoaluminate's hydration contributes to the high early strength of the investment mold. Mayenite is desirable in the cement because it provides strength during the early stages of mold curing due to the fast formation of hydraulic bonds. The mayenite is, however, typically removed during heat treatment of the mold prior to casting.

In one aspect, the initial calcium aluminate cement formulation is typically not at thermodynamic equilibrium after firing in the cement manufacturing kiln. However, after mold making and high-temperature firing, the mold composition moves towards a thermodynamically stable configuration, and this stability is advantageous for the subsequent casting process. In one embodiment, the weight fraction of calcium monoaluminate in the cement is greater than 0.5, and weight fraction of mayenite is less than 0.15. The mayenite is incorporated in the mold in both the bulk of the mold and the facecoat because it is a fast setting calcium aluminate and it is believed to provide the bulk of the mold and the facecoat with strength during the early stages of curing. Curing may be performed at low temperatures, for example, temperatures between 15 degrees Celsius and 40 degrees Celsius because the fugitive wax pattern is temperature sensitive and loses its shape and properties on thermal exposure above about 35 degrees C. It is preferred to cure the mold at temperatures below 30 degrees C.

The calcium aluminate cement may typically be produced by mixing high purity alumina with high purity calcium oxide or calcium carbonate; the mixture of compounds is typically heated to a high temperature, for example, temperatures between 1000 and 1500 degrees C. in a furnace or kiln and allowed to react.

The resulting product, known in the art as cement "clinker," that is produced in the kiln is then crushed, ground, and sieved to produce a calcium aluminate cement of the preferred particle size. Further, the calcium aluminate cement is designed and processed to have a minimum quantity of impurities, such as, minimum amounts of silica, sodium and other alkali, and iron oxide. In one aspect, the target level for the calcium aluminate cement is that the sum of the $Na_2O$, $SiO_2$, $Fe_2O_3$, and $TiO_2$ is less than about 2 weight percent. In one embodiment, the sum of the $Na_2O$, $SiO_2$, $Fe_2O_3$, and $TiO_2$ is less than about 0.05 weight percent.

In one aspect of the disclosure, a calcium aluminate cement with bulk alumina concentrations over 35% weight in alumina ($Al_2O_3$) and less than 65% weight calcium oxide is provided. In a related embodiment, this weight of calcium oxide is less than 50%. In one example, the maximum alumina concentration of the cement may be about 88% (for example, about 12% CaO). In one embodiment, the calcium aluminate cement is of high purity and contains up to 70% alumina. The weight fraction of calcium monoaluminate may be maximized in the fired mold prior to casting. A minimum amount of calcium oxide may be required to minimize reaction between the casting alloy and the mold. If there is more than 50% calcium oxide in the cement, this can lead to phases such as mayenite and tricalcium aluminate, and these do not perform as well as the calcium monoaluminate during casting. The preferred range for calcium oxide is less than about 50% and greater than about 10% by weight.

As noted above, the three phases in the calcium aluminate cement/binder in the mold are calcium monoaluminate ($CaAl_2O_4$), calcium dialuminate ($CaAl_4O_7$), and mayenite ($Ca_{12}Al_{14}O_{33}$). The calcium monoaluminate in the cement that generates the facecoat has several advantages over other calcium aluminate phases: (1) The calcium monoaluminate is incorporated in the mold because it has a fast setting response (although not as fast as mayenite) and it is believed to provide the mold with strength during the early stages of curing. The rapid generation of mold strength provides dimensional stability of the casting mold, and this feature improves the dimensional consistency of the final cast component. (2) The calcium monoaluminate is chemically stable with regard to the titanium and titanium aluminide alloys that are being cast. The calcium monoaluminate is used relative to the calcium dialuminate, and other calcium aluminate phases with higher alumina activity; these phases are more reactive with titanium and titanium aluminide alloys that are being cast. (3) The calcium monoaluminate and calcium dialuminate are low expansion phases and are understood to prevent the formation of high levels of stress in the mold during curing, dewaxing, and subsequent casting. The thermal expansion behavior of calcium monoaluminate is a close match with alumina.

The Facecoat

In certain embodiments, the mold contains a facecoat between the bulk of mold and the mold cavity. In one embodiment, the facecoat is a continuous facecoat. In another embodiment, the facecoat is an intrinsic facecoat. In a further embodiment, the facecoat is both a continuous and intrinsic facecoat. The mold is designed to contain phases that provide improved mold strength during mold making, and the continuous facecoat is designed to provide increased resistance to reaction during casting. The molds are capable of casting at high pressure, which is desirable for net-shape casting methods. A casting mold composition, a facecoat composition, and preferred constituent phases for the facecoat and the bulk of the mold, have been identified that provide castings with improved properties. While the continuous facecoat is described herein and has certain advantages depending upon the design criteria, the facecoat can also be non-continuous.

The facecoat is defined as the region of the mold adjacent to the internal surface, or mold cavity in the mold. In one embodiment, the facecoat is generally considered to be a region about 100 microns thick. In order to be more effective in certain applications, the facecoat is continuous. The region behind the facecoat and further away from the mold cavity is referred to as the bulk of the mold. In one embodiment, the facecoat is an intrinsic facecoat, wherein the intrinsic facecoat refers to the facecoat containing at least one component in common with the bulk of the mold. An extrinsic facecoat is a facecoat that contains a component that is not part of the bulk of the mold.

One aspect of the present disclosure is a facecoat composition of a mold that is used for casting a titanium-containing article, the facecoat composition comprising: calcium hexaluminate, calcium monoaluminate, calcium dialuminate, and mayenite, wherein the facecoat composition is an intrinsic facecoat, is about 10 microns to about 500 microns thick, and is located between the bulk of the mold and the surface of the mold that opens to the mold cavity. In one embodiment, the calcium hexaluminate comprises particles that are less than about 50 microns in outside dimension. The facecoat comprises, in one example, of calcium aluminate cement with a particle size of less than about 50 microns.

The use of an intrinsic facecoat has certain advantages over the use of an extrinsic facecoat. Specifically, extrinsic facecoats in molds that are used for casting, such as yttria or zircon, can degenerate, crack, and spall during mold processing and casting, specifically higher pressure casting. The pieces of facecoat that become detached from the extrinsic facecoat can become entrained in the casting when the mold is filled with molten metal, and the ceramic facecoat becomes an inclusion in the final part. The inclusion reduces the mechanical performance of the component that is produced from the casting.

In one embodiment, the present disclosure provides an intrinsic facecoat composition for investment casting molds, and a bulk mold composition, that together can provide improved cast components of titanium and titanium alloys. In one embodiment, the mold comprises calcium hexaluminate, calcium aluminate cement, and alumina particles. In one example, the calcium aluminate cement serves several functions. First the cement generates an intrinsic facecoat in the cavity of the mold that is generated by removal of a fugitive pattern, and second it acts as a binder between the alumina particles in the bulk of the mold behind the facecoat. In one embodiment, the bulk composition range for CaO in the mold is between 10 and 50 weight percent. In one embodiment, the composition of CaO in the facecoat is between 20 and 40 weight percent. In one embodiment, the final mold has a density of less than 2 grams/cubic centimeter and a strength of greater than 500 psi.

The mold may comprise the bulk of the mold and an intrinsic facecoat, with the bulk of the mold and the intrinsic facecoat having different compositions, and the intrinsic facecoat comprising calcium aluminate cement with a particle size of less than about 50 microns. The mold may comprise the bulk of the mold and an intrinsic facecoat, wherein the bulk of the mold and the intrinsic facecoat have different compositions and wherein the bulk of the mold comprises alumina particles larger than about 50 microns. The mold, in one example, comprises the bulk of the mold and an intrinsic facecoat, wherein the bulk of the mold comprises alumina particles larger than about 50 microns and the intrinsic facecoat comprises calcium aluminate particles less than about 50 microns in size.

Net shape casting approaches as provided for in the present disclosure allow parts that can be inspected with non destructive methods, such as x-ray, ultrasound, or eddy current, in greater detail and at lower costs. The difficulties associated with attenuation and scattering of the inspection radiation in oversized thick sections is reduced. Smaller defects can potentially be resolved, and this can provide parts with improved mechanical performance.

The present disclosure provides a casting mold composition and a casting process that can provide improved components of titanium and titanium alloys. In one embodiment, the mold is constructed using calcium hexaluminate, calcium aluminate cement, or binder, and alumina particles. In an embodiment, the mold contains an intrinsic facecoat between the bulk of mold and the mold cavity. The size of the particles in the facecoat are typically less than 50 microns. The size of the particles in the bulk of the mold can be larger than 50 microns. In one embodiment, the size of the particles in the bulk of the mold are greater than 1 mm. In one embodiment, the size of the particles in the facecoat are less than 50 microns, and the size of the particles in the bulk of the mold are more than 50 microns. Generally, the facecoat is continuous intrinsic facecoat, allowing it to be more effective.

The intrinsic facecoat may have, by weight fraction, at least 20 percent more calcium aluminate, at least 20 percent less alumina, and at least 50 percent less mayenite than does the bulk of the mold. The weight fraction of calcium monoaluminate in the intrinsic facecoat may be more than 0.30 and the weight fraction of mayenite may be less than 0.10. In one example, the calcium hexaluminate in the intrinsic facecoat comprises a weight fraction of 0.01 to 0.20; the calcium monoaluminate in the intrinsic facecoat comprises a weight fraction of 0.30 to 0.95; the calcium dialuminate in the intrinsic facecoat comprises a weight fraction of 0.05 to 0.30; and the mayenite in the intrinsic facecoat comprises a weight fraction of 0.01 to 0.05. The increased weight fraction of calcium monoaluminate in the intrinsic facecoat reduces the rate of reaction of the molten alloy with the mold during casting.

The intrinsic facecoat may have, by weight fraction, at least 20 percent more calcium monoaluminate than the bulk of the mold. The intrinsic facecoat may have, by weight fraction, at least 20 percent less alumina than the bulk of the mold. In one example, the intrinsic facecoat may have, by weight fraction, at least 20 percent more calcium aluminate, at least 20 percent less alumina, and at least 50 percent less mayenite than does the bulk of the mold.

In certain embodiments, the constituent phases of the facecoat, as well as the constituent phases of the bulk of the mold, are important to the properties of the casting. As disclosed herein, the facecoat of the mold provides minimum reaction with the alloy during casting, and as a result the mold provides castings with the required component properties. External properties of the casting include features such as shape, geometry, and surface finish. Internal properties of the casting include mechanical properties, microstructure, and defects (such as pores and inclusions) below a critical size.

With respect to constituent phases of the facecoat of the mold and the bulk of the mold, calcium monoaluminate ($CaAl_2O_4$) is desirable for at least two reasons. First, calcium monoaluminate promotes hydraulic bond formation between the cement particles during the initial stages of mold making, and this hydraulic bonding provides mold strength during mold construction. Second, calcium monoaluminate experiences a very low rate of reaction with titanium and titanium aluminide based alloys.

In one embodiment, the facecoat comprises calcium hexaluminate ($CaO.6Al_2O_3$, also referred to as "CA6"), calcium monoaluminate ($CaAl_2O_4$), calcium dialuminate ($CaAl_4O_7$), and mayenite ($Ca_{12}Al_{14}O_{33}$), and alumina. In one embodiment, the size of the particles in the facecoat are less than 50 microns. In the facecoat, the combination of calcium monoaluminate ($CaAl_2O_4$), calcium dialuminate ($CaAl_4O_7$) is more than 50 weight percent, and the alumina concentration is less than 50 weight percent. In one embodiment, there is more than 30 weight percent calcium monoaluminate ($CaAl_2O_4$) in the facecoat. The region behind the facecoat and further away from the mold cavity is referred to as the bulk of the mold. In this bulk of the mold section, in one embodiment, the combination of calcium monoaluminate ($CaAl_2O_4$), calcium dialuminate ($CaAl_4O_7$), and calcium hexaluminate is less than 50 weight percent, and the alumina concentration in the bulk of the mold is greater than 50 weight percent.

The use of an intrinsic facecoat has significant advantages over the use of an extrinsic facecoat. Extrinsic facecoats that are used in casting titanium alloys are typically yttria based facecoats, or zirconia based facecoats. Specifically, extrinsic facecoats in molds that are used for casting can degenerate, crack, and spall during mold processing (such as removal of the fugitive pattern and firing) and casting. The pieces of facecoat that become detached from the extrinsic facecoat can become entrained in the casting when the mold is filled with molten metal, and the ceramic facecoat becomes an inclusion in the final part. The inclusion reduces the mechanical performance of the component that is produced from the casting.

The calcium aluminate cement is referred to as a cement or binder, and in one embodiment, it is mixed with alumina particulate to make a castable investment mold mix. The calcium aluminate cement is typically >30% by weight in the castable investment mold mix; the use of this proportion of calcium aluminate cement is a feature of the present disclosure because it favors formation of an intrinsic facecoat. Applicants found that the selection of the correct calcium aluminate cement chemistry and alumina formulation are important in determining the performance of the mold. In one example, in terms of the calcium aluminate cement, Applicants used a particular amount of calcium oxide (CaO) in order to minimize reaction with the titanium alloy.

In one embodiment, the facecoat comprises calcium aluminate cement with a particle size of less than about 50 microns. In another embodiment, the particle size of the calcium aluminate cement is less than about 10 microns. In one example, the bulk of the mold has particles greater than 50 microns in size and can contain alumina.

The facecoat has less alumina and more calcium aluminate cement than the bulk of the mold. The intrinsic facecoat may have, by weight fraction, at least 20 percent more calcium monoaluminate, at least 20 percent less alumina, and at least 50 percent less mayenite than does the bulk of the mold. In one example, the calcium hexaluminate in the intrinsic facecoat comprises a weight fraction of 0.01 to 0.20; the calcium monoaluminate in the intrinsic facecoat comprises a weight fraction of 0.30 to 0.95; the calcium dialuminate in the intrinsic facecoat comprises a weight fraction of 0.05 to 0.30; and the mayenite in the intrinsic facecoat comprises a weight fraction of 0.01 to 0.05. The increased weight fraction of calcium monoaluminate and dialuminate in the intrinsic facecoat reduces the rate of reaction of the molten alloy with the mold during casting.

The initial cement slurry is mixed to have a viscosity of between 30 and 300 centipoise. In one embodiment, viscosity range is between 80 and 120 centipoise. If the viscosity is too low, the slurry will not maintain all the solids in suspension, and settling of the heavier particles will occur and lead to segregation during curing, and an intrinsic facecoat will not be formed. If the viscosity is too high, the calcium aluminate particles cannot partition to the fugitive pattern, and the intrinsic facecoat will not be formed. The final slurry with the calcium aluminate cement, calcium hexaluminate, and the alumina particles is mixed to have a viscosity of between approximately 2000 and 8000 centipoise. In one embodiment, this final slurry viscosity range is between 3000 and 6000 centipoise. If the final slurry/mix viscosity is too high, the final slurry mix will not flow around the fugitive pattern, and the internal cavity of the mold will not be suitable for casting the final required part. If the final slurry mix viscosity is too low, settling of the heavier particles will occur during curing, and the mold will not have the required uniform composition throughout the bulk of the mold.

The investment mold formulation consists of a multiphase mixture of fine-scale (<50 microns) calcium aluminate cement particles, fine-scale (<50 microns) alumina particles, fine-scale (<50 microns) calcium hexaluminate, and larger scale (such as >50 microns) alumina particles. The intrinsic facecoat does not contain any alumina particles greater than 50 microns. The intrinsic facecoat is formed because the fine-scale cement particles and the calcium hexaluminate particles that are in suspension in the water-based investment mix partition preferentially to the fugitive/wax pattern during mold making, and form an intrinsic facecoat layer that is enriched in the fine-scale particles (<50 microns), including the calcium hexaluminate, calcium monoaluminate, calcium dialuminate, and free alumina particles. In one embodiment, there are no large-scale alumina particles (such as >50 microns) in the facecoat. The slurry viscosity and the solids loading are factors in forming the intrinsic facecoat. The absence of large-scale (such as >50 micron) particles in the intrinsic facecoat improves the surface finish of the mold and the resulting casting. The increased weight fraction of the calcium monoaluminate and the calcium dialuminate in the intrinsic facecoat reduces the rate of reaction of the molten alloy with the mold during casting.

In the bulk of the mold, the calcium aluminate cement is the binder, and the binder is considered the main skeleton of the mold structure behind the facecoat. It is the continuous phase in the mold and provides strength during curing, and casting. In one embodiment, the bulk of the mold composition comprises fine-scale (<50 microns) calcium aluminate cement particles, and larger scale (such as >50 microns) alumina particles. In another embodiment, the intrinsic facecoat composition comprises calcium aluminate cement and calcium hexaluminate.

The calcium aluminate cement that makes up the facecoat comprises at least three phases: calcium monoaluminate ($CaAl_2O_4$); calcium dialuminate ($CaAl_4O_7$); and mayenite ($Ca_{12}Al_{14}O_{33}$). In one embodiment, the facecoat can also contain fine-scale alumina particles. In one embodiment, the facecoat can also include calcium hexaluminate. In another embodiment, the bulk of the mold behind the facecoat comprises calcium monoaluminate ($CaAl_2O_4$), calcium dialuminate ($CaAl_4O_7$), mayenite ($Ca_{12}Al_{14}O_{33}$), calcium hexaluminate, and alumina. The alumina can be incorporated as large scale alumina particles (such as greater than 50 microns), for example hollow alumina particles. The particles can have a range of geometries, such as round particles, or irregular aggregates. The alumina particle size can be as small as 50 microns and as large as 10 mm.

In one embodiment, the alumina consists of both round particles and hollow particles, since these geometries reduce the viscosity of the investment mold mixture. Typically the alumina particle size in the bulk of the mold is greater than 50 microns. The viscosity impacts the manner in which the cement partitions to the fugitive pattern (such as a wax) during pouring and setting of the investment mold mix around the fugitive pattern. The viscosity also affects the surface finish of the mold, and fidelity of the surface features of the final casting produced from the mold.

According to certain embodiments, if the viscosity of the initial cement mix is too low, the slurry will not maintain all the solids in suspension, and settling of the heavier particles will occur and lead to segregation during curing, and an intrinsic facecoat will not be formed. If the viscosity is too high, the calcium aluminate particles cannot partition to the fugitive pattern, and the intrinsic facecoat will not be formed. If the final mix viscosity is too high, the final slurry mix will not flow around the fugitive pattern, air will be trapped between the slurry mix and the pattern, and the internal cavity of the mold will not be suitable for casting the final required part. If the final slurry mix viscosity is too low, settling of the heavier particles will occur during curing, and the mold will not have the required uniform composition throughout the bulk of the mold, and the quality of the resulting casting will be compromised.

The calcium aluminate cement particulate that generates the facecoat typically has a particle size of less than 50 microns. A particle size of less than 50 microns has several advantages, including: first, the fine particle size promotes the formation of hydraulic bonds during mold mixing and curing, second the fine particle size can promote inter-particle sintering during firing, and this can increase the mold strength, and third, the fine particle size improves surface finish of the mold cavity. The calcium aluminate cement powder can be used either in its intrinsic form, or in an agglomerated form, such as spray dried agglomerates. The calcium aluminate cement can also be preblended with fine-scale (<10 micron) alumina before mixing with larger-scale alumina; the fine-scale alumina can provide an increase in strength due to sintering during high-temperature firing. However, if the alumina particles partition to the facecoat, the casting properties can be reduced.

For example, if the alumina particles partition to the facecoat, such that the intrinsic facecoat has more alumina than the bulk of the mold, the molten alloy will react with the alumina in an undesirable way and generate gas bubbles that create surface defects and defects within the casting itself. The properties of the resulting casting, such as strength and fatigue strength are reduced. The presently disclosed methods allow for the formation of a facecoat that has significantly less alumina in the intrinsic facecoat than in the bulk of the mold.

The treatment of the facecoat and the mold from room temperature to the final firing temperature can also be important, specifically the thermal history and the humidity profile. The heating rate to the firing temperature, and the cooling rate after firing are very important. If the facecoat and the mold are heated too quickly, they can crack internally or externally, or both; facecoat and mold cracking prior to casting is highly undesirable, it will generate poor surface finish, at least. In addition, if the mold and facecoat are heated too quickly the facecoat of the mold can crack and spall off; this can lead to undesirable inclusions in the final casting in the worst case, and poor surface finish, even if there are no inclusions. If the facecoat and the mold are cooled too quickly after reaching the maximum mold firing temperature, the facecoat or the bulk of the mold can also crack internally or externally, or both.

The solids loading of the initial cement mix and the solids loading of the final mold mix have important effects on the mold structure and the ability to form an intrinsic facecoat within the mold, as will be described in the following paragraphs. The percentage of solids loading is defined as the total solids in the mix divided by the total mass of the liquid and solids in the mix, described as a percentage. In one embodiment, the percentage of solids in the initial calcium hexaluminate-calcium aluminate cement liquid mix is about 65 percent to 80 percent.

If the solids loading in the initial calcium hexaluminate-calcium aluminate cement liquid mix is less than about 65 percent, then the calcium hexaluminate and calcium aluminate cement particles will not remain in suspension and during curing of the mold the cement particles will separate from the water and the composition will not be uniform throughout the mold. In contrast, if the solids loading is too high in the calcium hexaluminate-calcium aluminate cement liquid mix (for example greater than about 80 percent), the viscosity of the final mix with the large-scale alumina will be too high (for example greater than about 85%, depending on the amount, size, and morphology of the large-scale alumina particles that are added), and the calcium hexaluminate and calcium aluminate cement particles in the mix will not be able to partition to the fugitive pattern within the mold, and the intrinsic facecoat will not be formed.

In one embodiment, the percentage of solids in the final calcium hexaluminate-calcium aluminate cement liquid mix with the large-scale (meaning greater than about 50 microns in one embodiment, and greater than about 100 microns in another embodiment) alumina particles is about 75 percent to about 95 percent. In one embodiment, the percentage of solids in the final calcium hexaluminate-calcium aluminate cement liquid mix with the large-scale alumina particles is about 78 percent to about 88 percent. In another embodiment, the percentage of solids in the final calcium hexaluminate-calcium aluminate cement liquid mix with the large-scale alumina particles is about 78 percent to about 84 percent. In a particular embodiment, the percentage of solids in the final calcium hexaluminate-calcium aluminate cement liquid mix with the large-scale alumina particles is about 80 percent.

The Mold Making and Casting Methods

An investment mold is formed by formulating the investment mix of the ceramic components, and pouring the mix into a vessel that contains a fugitive pattern. The investment mold formed on the pattern is allowed to cure thoroughly to form a so-called "green mold." The intrinsic facecoat and the investment mold are formed on the pattern and they are allowed to cure thoroughly to form this green mold. Typically, curing of the green mold is performed for times from 1 hour to 48 hours. Subsequently, the fugitive pattern is selectively removed from the green mold by melting, dissolution, ignition, or other known pattern removal technique. Typical methods for wax pattern removal include oven dewax (less than 150 degrees C.), furnace dewax (greater than 150 degrees C.), steam autoclave dewax, and microwave dewaxing.

For casting titanium alloys, and titanium aluminide and its alloys, the green mold then is fired at a temperature above 600 degrees C., for example 600 to 1400 degrees C., for a time period in excess of 1 hour, preferably 2 to 10 hours, to develop mold strength for casting and to remove any undesirable residual impurities in the mold, such as metallic species (Fe, Ni, Cr), and carbon-containing species. In one example, the firing temperature is at least 950 degrees C. The atmosphere of firing the mold is typically ambient air, although inert gas or a reducing gas atmosphere can be used.

The firing process also removes the water from the mold and converts the mayenite to calcium monoaluminate. Another purpose of the mold firing procedure is to minimize any free silica that remains in the facecoat and mold prior to casting. Other purposes are to increase the high temperature strength, and increase the amount of calcium monoaluminate and calcium dialuminate.

The mold is heated from room temperature to the final firing temperature, specifically the thermal history is controlled. The heating rate to the firing temperature, and the cooling rate after firing are typically regulated or controlled. If the mold is heated too quickly, it can crack internally or externally, or both; mold cracking prior to casting is highly undesirable. In addition, if the mold is heated too quickly, the internal surface of the mold can crack and spall off. This can lead to undesirable inclusions in the final casting, and poor surface finish, even if there are no inclusions. Similarly, if the mold is cooled too quickly after reaching the maximum temperature, the mold can also crack internally or externally, or both.

The mold composition described in the present disclosure is particularly suitable for titanium and titanium aluminide alloys. The facecoat and the bulk of the mold composition after firing and before casting can influence the mold properties, particularly with regard to the constituent phases. In one embodiment, for casting purposes, a high weight fraction of calcium monoaluminate in the mold is employed, for example, a weight fraction of 0.15 to 0.6. In addition, for casting purposes, it is sometimes desirable to minimize the weight fraction of the mayenite, for example, using a weight fraction of 0.01 to 0.2, because mayenite is water sensitive and it can provide problems with water release and gas generation during casting.

After firing, the mold can also contain small weight fractions of aluminosilicates and calcium aluminosilicates. In order to minimize reaction of the mold with the casting, the sum of the weight fraction of aluminosilicates and calcium aluminosilicates in the bulk may typically be kept to less than 5% in one embodiment, less than 2% in another embodiment, and less than 1% in a further embodiment, and the weight fraction of aluminosilicates and calcium aluminosilicates in the facecoat may typically be kept to less than 0.5% in one embodiment, less than 0.2% in another embodiment, and less than 0.1% in a further embodiment.

One aspect of the present disclosure is a method for forming a casting mold for casting a titanium-containing article, the method comprising: (a) providing an initial slurry of a calcium hexaluminate-calcium aluminate cement mixture, wherein the percentage of solids in the initial slurry is about 65% to about 80% and the viscosity of the initial slurry is about 30 to about 300 centipoise; (b) adding large-scale oxide particles (greater than 50 microns) into the initial slurry to yield a final slurry comprising the calcium hexaluminate-calcium aluminate cement mixture with the large-scale oxide particles such that the percentage of solids in the final slurry is about 75% to about 95%; (c) introducing the final slurry into a mold cavity that contains a fugitive pattern; and (d) allowing the final slurry to cure in the mold cavity to form a mold for casting a titanium-containing article.

In one embodiment, the step of providing the initial slurry comprises: combining calcium hexaluminate and calcium aluminate cement with a liquid to produce an initial slurry of a calcium hexaluminate-calcium aluminate cement mixture, wherein the percentage of solids in the initial slurry is about 65% to about 80% and the viscosity of the initial slurry is about 30 to about 300 centipoise.

In one embodiment, the step of providing the initial slurry comprises: combining calcium hexaluminate and calcium aluminate cement with a liquid to produce a pre-initial slurry of a calcium hexaluminate-calcium aluminate cement mixture, wherein the percentage of solids in the pre-initial slurry is about 41% to about 65%; and adding more calcium hexaluminate, calcium aluminate cement, and/or liquid to the pre-initial slurry to yield the initial slurry having a percentage of solids of about 65% to about 80% and a viscosity of about 30 to about 300 centipoise. As used herein, combining calcium hexaluminate and calcium aluminate cement with a liquid is meant to include all possible methods of combining these compounds with the liquid. For example, the combining of the the calcium hexaluminate and calcium aluminate cement with a liquid can include, without limitation: (i) mixing the calcium hexaluminate and calcium aluminate cement together and then adding the liquid to the calcium hexaluminate/calcium aluminate cement mixture; (ii) mixing the calcium hexaluminate with the liquid and then adding in the calcium aluminate cement; (iii) mixing the calcium aluminate cement with the liquid and then adding in the calcium hexaluminate; (iv) simultaneously adding the calcium hexaluminate and calcium aluminate cement into the liquid; and (v) any other variations and orders of mixing the calcium hexaluminate and calcium aluminate cement with the liquid.

In certain embodiments, the casting-mold composition of the present disclosure comprises an investment casting-mold composition. The investment casting-mold composition comprises a near-net-shape, titanium-containing metal, investment casting mold composition. In one embodiment, the investment casting-mold composition comprises an investment casting-mold composition for casting near-net-shape titanium aluminide articles. The near-net-shape titanium aluminide articles comprise, for example, near-net-shape titanium aluminide turbine blades.

The selection of the correct calcium aluminate cement chemistry and alumina formulation are factors in the performance of the mold during casting. In terms of the calcium aluminate cement, it may be necessary to adjust the amount of free calcium oxide in order to minimize reaction with the titanium alloy. If the calcium oxide concentration in the cement is less than about 10% by weight, the alloy reacts with the mold because the alumina concentration is too high, and the reaction generates undesirable oxygen concentration levels in the casting, gas bubbles, and a poor surface finish in the cast component. Free alumina is less desirable in the mold material because it can react aggressively with titanium and titanium aluminide alloys.

If the calcium oxide concentration in the cement is greater than 50% by weight, the mold can be sensitive to pick up of water and carbon dioxide from the environment. As such, the calcium oxide concentration in the investment mold may typically be kept below 50%. In one embodiment, the calcium oxide concentration in the bulk of the investment mold is between 10% and 50% by weight. In one embodiment, the calcium oxide concentration in the bulk of the investment mold is between 10% and 40% by weight. Alternatively, the calcium oxide concentration in the bulk of the investment mold may be between 25% and 35% by weight. In one embodiment, the composition of CaO in the facecoat is between 20 and 40 percent by weight. In another embodiment, the calcium oxide concentration in the facecoat of the mold is between 15% and 30% by weight.

Prior to casting a molten metal or alloy, the investment mold typically is preheated to a mold casting temperature that is dependent on the particular component geometry or alloy to be cast. For example, a typical mold preheat temperature is 600 degrees C. Typically, the mold temperature range is 450 degrees C. to 1200 degrees C.; the preferred temperature range is 450 degrees C. to 750 degrees C., and in certain cases it is 500 degrees C. to 650 degrees C.

According to one aspect, the molten metal or alloy is poured into the mold using conventional techniques which can include gravity, countergravity, pressure, centrifugal, and other casting techniques known to those skilled in the art. Vacuum or inert gas atmospheres can be used. For complex shaped thin wall geometries, techniques that use high pressure are preferred. After the solidified titanium aluminide or alloy casting is cooled typically to less than 650 degrees, for example, to room temperature, it is removed from the mold and finished using conventional techniques, such as, grit blasting, and polishing.

One aspect of the present disclosure is a casting method for titanium and titanium alloys comprising: (a) obtaining an investment casting mold composition comprising calcium hexaluminate, calcium aluminate cement, and aluminum oxide, the investment casting mold composition being produced by combining calcium hexaluminate and calcium aluminate cement with a liquid to produce an initial slurry of a calcium hexaluminate-calcium aluminate cement mixture having a percentage of solids of about 65% to about 80% and adding large-scale aluminum oxide particles into the initial slurry to yield a final slurry comprising the calcium hexaluminate-calcium aluminate cement mixture with the large-scale aluminum oxide particles such that the percentage of solids in the final slurry is about 75% to about 95%; (b) pouring the investment casting mold composition into a vessel containing a fugitive pattern; (c) curing the investment casting mold composition; (d) removing the fugitive pattern from the mold; (e) firing the mold; (f) preheating the mold to a mold casting temperature; (g) pouring molten titanium or titanium alloy into the heated mold; (h) solidifying the molten titanium or titanium alloy and forming a solidified titanium or titanium alloy casting; and (i) removing the solidified titanium or titanium alloy casting from the mold. In one embodiment, a titanium or titanium alloy article is claimed that is made by the casting method as taught herein.

Between removing the fugitive pattern from the mold and preheating the mold to a mold casting temperature, the mold is first heated, or fired, to a temperature of about 600 degrees C. to about 1400 degrees C., for example about 950 degrees C. or higher, and then cooled to room temperature.

In one embodiment, the curing step is conducted at temperatures below about 30 degrees C. for between one hour to 48 hours. The removing of the fugitive pattern includes the step of melting, dissolution, ignition, oven dewaxing, furnace dewaxing, steam autoclave dewaxing, or microwave dewaxing.

In one embodiment, after removing of the titanium or titanium alloy from the mold, the casting may be finished with grit blasting or polishing. In one embodiment, after the solidified casting is removed from the mold, it is inspected by X-ray.

The solidified casting is subjected to surface inspection and X-ray radiography after casting and finishing to detect any sub-surface inclusion particles at any location within the casting. X-ray radiography is employed to find inclusions that are not detectable by visual inspection of the exterior surface of the casting. The titanium aluminide casting is subjected to X-ray radiography (film or digital) using conventional X-ray equipment to provide an X-ray radiograph that then is inspected or analyzed to determine if any sub-surface inclusions are present within the titanium aluminide casting.

Another aspect of the present disclosure is a method for forming a casting mold for casting a titanium-containing article. The method includes: combining calcium hexaluminate and calcium aluminate cement with a liquid, such as water, to produce a slurry of calcium hexaluminate-calcium aluminate cement in the liquid; introducing the slurry into a vessel that contains a fugitive pattern; and allowing the slurry to cure in the mold cavity to form a mold of a titanium-containing article. In one embodiment, the method further comprises, before introducing the slurry into a mold cavity, introducing oxide particles, for example hollow oxide particles, to the slurry.

The formed mold may be a green mold, and the method may further comprise firing the green mold. In one embodiment, the casting mold comprises an investment casting mold, for example, for casting a titanium-containing article. In one embodiment, the titanium-containing article comprises a titanium aluminide article. In one embodiment, the investment casting-mold composition comprises an investment casting-mold composition for casting near-net-shape titanium aluminide articles. The near-net-shape titanium aluminide articles may comprise near-net-shape titanium aluminide turbine blades. In one embodiment, the disclosure is directed to a mold formed from a titanium-containing article casting-mold composition, as taught herein. Another aspect of the present disclosure is directed to an article formed in the aforementioned mold.

Yet another aspect of the present disclosure is a titanium or titanium alloy casting made by a casting method comprising: obtaining an investment casting mold composition comprising calcium hexaluminate, calcium aluminate cement, and aluminum oxide; pouring the investment casting mold composition into a vessel containing a fugitive pattern; curing the investment casting mold composition; removing the fugitive pattern from the mold; firing the mold; preheating the mold to a mold casting temperature; pouring molten titanium or titanium alloy into the heated mold; solidifying the molten titanium or titanium alloy to form the casting; and removing a solidified titanium or titanium alloy casting from the mold. In one embodiment, the investment casting mold that is obtained for use in this method includes a facecoat as described herein, which can be an intrinsic facecoat. In one embodiment, the present disclosure is directed to a titanium or titanium alloy article made by the casting methods taught in this application.

Surface roughness is one of the important indices representing the surface integrity of cast and machined parts. Surface roughness is characterized by the centerline average roughness value "Ra", as well as the average peak-to-valley distance "Rz" in a designated area as measured by optical profilometry. A roughness value can either be calculated on a profile or on a surface. The profile roughness parameter (Ra, Rq, . . . ) are more common. Each of the roughness parameters is calculated using a formula for describing the surface. There are many different roughness parameters in use, but $R_a$ is by far the most common.

The average roughness, Ra, is expressed in units of height. In the Imperial (English) system, 1 Ra is typically expressed in "millionths" of an inch. This is also referred to as "microinches." The Ra values indicated herein refer to microinches. An Ra value of 70 corresponds to approximately 2 microns; and an Ra value of 35 corresponds to approximately 1 micron. It is typically required that the surface of high performance articles, such as turbine blades, turbine vanes/nozzles, turbochargers, reciprocating engine valves, pistons, and the like, have an Ra of about 20 or less. One aspect of the present disclosure is a turbine blade comprising titanium or titanium alloy and having an average roughness, Ra, of less than 20 across at least a portion of its surface area.

As the molten metals are heated higher and higher, they tend to become more and more reactive (e.g., undergoing unwanted reactions with the mold surface). Such reactions lead to the formation of impurities that contaminate the metal parts, which result in various detrimental consequences. The presence of impurities shifts the composition of the metal such that it may not meet the desired standard, thereby disallowing the use of the cast piece for the intended application. Moreover, the presence of the impurities can detrimentally affect the mechanical properties of the metallic material (e.g., lowering the strength of the material).

Furthermore, such reactions can lead to surface texturing such as pits, porosity, and roughness, which results in substantial, undesirable roughness on the surface of the cast piece. For example, using the surface roughness value Ra, as known in the art for characterizing surface roughness, cast pieces utilizing stainless steel alloys and/or titanium alloys are typically exhibit an Ra value between about 100 and 200 under good working conditions.

One aspect of the present disclosure is directed to a mold composition for casting a titanium-containing article, comprising calcium hexaluminate and calcium aluminate cement. The mold composition further comprises hollow alumina particles. The article comprises a metallic article. In one embodiment, the article comprises a titanium aluminide-containing article. In another embodiment, the article comprises a titanium aluminide turbine blade. In yet another embodiment, the article comprises a near-net-shape, titanium aluminide turbine blade. This near-net-shape, titanium aluminide turbine blade may require little or no material removal prior to installation.

EXAMPLES

The disclosure, having been generally described, may be more readily understood by reference to the following examples, which are included merely for purposes of illustration of certain aspects and embodiments of the present disclosure, and are not intended to limit the disclosure in any way.

Figure 2:
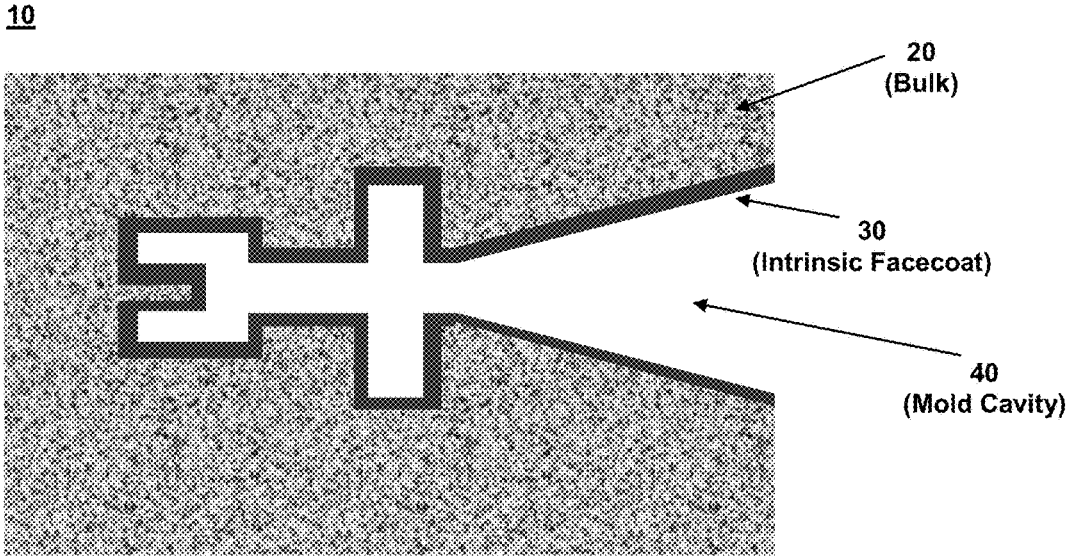
FIG. 2 is a schematic of one embodiment of a mold of the present disclosure. The mold is shown as having a bulk, a cavity, and an intrinsic facecoat disposed between the bulk and the cavity.

FIGS. 1 and 2 are schematics showing various embodiments of a mold of the present disclosure. FIG. 1 shows mold 10 having bulk 20 and cavity 40, with bulk 20 comprising calcium hexaluminate and calcium aluminate cement. FIG. 2 shows mold 10 having bulk 20, cavity 40, and intrinsic facecoat 30 disposed between bulk 20 and cavity 40, with bulk 20 and intrinsic facecoat both comprising calcium hexaluminate and calcium aluminate cement, but in different amounts or proportions.

Investment Mold Composition and Formulation

Calcium hexaluminate and a calcium aluminate cement were mixed with alumina to generate an investment mold mix, and a range of investment mold chemistries were tested. The investment mixture in one example consisted of calcium hexaluminate and calcium aluminate cement with 70% alumina and 30% calcia, alumina particles, water, and colloidal silica.

One embodiment of the preparation of the mold is as follows: The mold mix is prepared by mixing the cement, water, and collodial silica in a container. It is preferred to use a high-shear form of mixing. If not mixed appropriately the calcium aluminate cement mix can gel. When the cement is in suspension in the mixture, the alumina particles are added. When the fine-scale alumina particles are fully mixed with the cement, the calcium hexaluminate particulate is added and mixed with the slurry. When the fine-scale calcium hexaluminate particulate are fully mixed with the cement, the larger-size (for example 0.5-1.0 mm) alumina particles are added and mixed with the cement-alumina formulation. The viscosity of the final mix is a factor to consider; it should preferably not be too low or too high. After mixing, the investment mix is poured in a controlled manner into a vessel that contains the fugitive pattern such as a wax pattern. The vessel provides the external geometry of the mold, and the fugitive pattern generates the internal geometry. The correct pour speed is a factor to consider, if it is too fast air can be entrapped in the mold, if it is too slow separation of the cement and the alumina particulate can occur.

Figure 3:
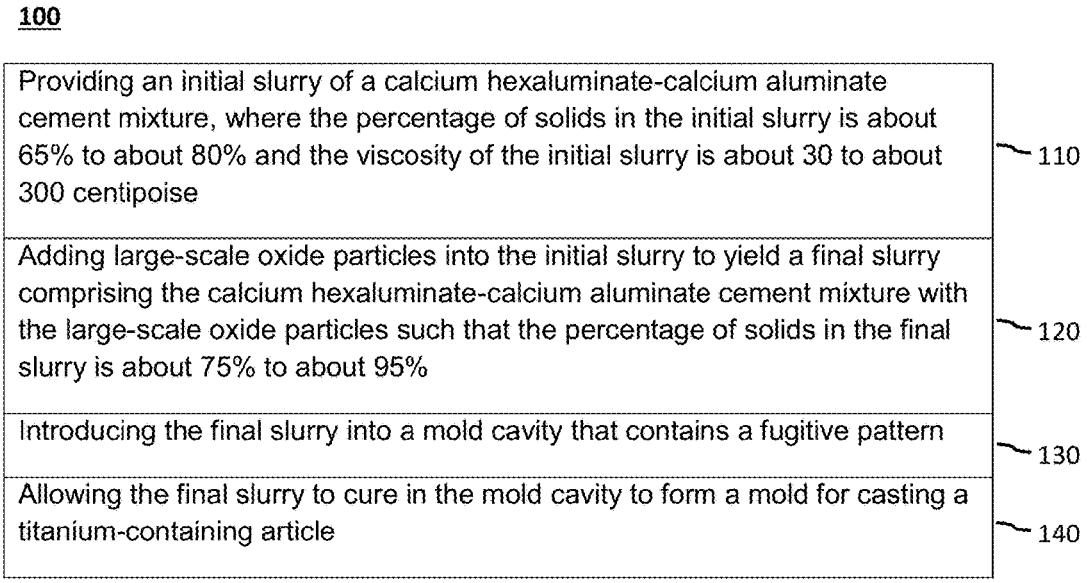
FIG. 3 shows a flow chart, in accordance with aspects of the disclosure, illustrating a method for forming a casting mold for casting a titanium-containing article.

As shown in FIG. 3, in one embodiment, method 100 of the present disclosure comprises providing an initial slurry of a calcium hexaluminate-calcium aluminate cement mixture (110). The percentage of solids in the initial slurry is about 65% to about 80% and the viscosity of the initial slurry is about 30 to about 300 centipoise. In one embodiment, large-scale oxide particles are added into the initial slurry to yield a final slurry comprising the calcium hexaluminate-calcium aluminate cement mixture with the large-scale oxide particles such that the percentage of solids in the final slurry is about 75% to about 95% (120). The final slurry is introduced into a mold cavity that contains a fugitive pattern (130). The final slurry is allowed to cure in the mold cavity to form a mold for casting a titanium or titanium-containing article (140).

In another example, shown in FIG. 4, method 200 comprises obtaining an investment casting mold composition comprising calcium hexaluminate, calcium aluminate cement, and aluminum oxide (210). In one example the investment mold composition is produced by combining calcium hexaluminate and calcium aluminate cement with a liquid to produce an initial slurry of a calcium hexaluminate-calcium aluminate cement mixture having a percentage of solids of about 65% to about 80%. Large scale aluminum oxide particles are then added into the initial slurry to yield a final slurry. The final slurry includes the final calcium hexaluminate-calcium aluminate cement mixture with large scale aluminum oxide particles (such as >50 microns) such that the percentage of solids in the final slurry is about 75% to about 95%. The investment casting mold composition is poured into a vessel containing a fugitive pattern (220). The investment casting mold is cured thereby providing the casting mold composition (230). The fugitive pattern is removed from the mold (240), and the mold is fired (250). The mold is preheated to a mold casting temperature (260), and the molten titanium or titanium alloy is poured into the heated mold (270). The molten titanium or titanium alloy is solidified and forms a solidified titanium or titanium alloy casting (280). Finally, the solidified titanium or titanium alloy casting is removed from the mold (290).

The calcium hexaluminate is typically incorporated as particles with a size of less than 100 microns. The calcium hexaluminate powder used for the examples described in the present disclosure had a maximum particle size of 43 microns in some cases, and less than 20 microns in some examples that are described. The large scale alumina (such as >50 microns) can be incorporated as alumina particles, or alumina bubbles. The particles can have a range of geometries, such as round particles, or irregular aggregate. The large scale alumina particle size can be as small as 50 microns and as large as 10 mm. It is preferred that the alumina consists of both round particles and bubbles, since these geometries reduce the viscosity of the investment mold mixture. The reduced viscosity improves the surface finish and fidelity of the surface features of the final casting produced from the mold. The calcium aluminate cement particulate typically has a particle size of less than 50 microns. A particle size of less than 50 microns is preferred for three reasons: first, the fine particle size promotes the formation of hydraulic bonds during mold mixing and curing, second the fine particle size can promote inter-particle sintering during firing, and this can increase the mold strength, and third, the fine particle size improves surface finish. The calcium aluminate cement powder can be used either in its intrinsic form, or in an agglomerated form, such as spray dried agglomerates. The calcium aluminate cement can also be preblended with fine-scale (<10 micron) alumina before mixing with larger-scale alumina; the fine-scale alumina can provide an increase in strength due to sintering during high-temperature firing. Similarly, the calcium hexaluminate particulate typically has a particle size of less than 100 microns, and preferably less than 50 microns; at this size it can be intimately mixed with the calcium aluminate cement particles, and it can contribute to the performance of the facecoat. The calcium hexaluminate particles with a size of less than 100 microns can improve the surface finish of the mold and the subsequent cast component.

The calcium hexaluminate is typically incorporated as particles with a size of less than 100 microns. The calcium hexaluminate powder used for the examples described in the present disclosure had a maximum particle size of 43 microns in some cases, and less than 20 microns in some examples that are described.

In a first example, a slurry mixture for making an investment mold consisted of 1354 g of a commercially blended 80% calcium aluminate cement. The calcium aluminate cement nominally consists of a 70% calcium aluminate cement blended with alumina to adjust the composition to 80% alumina. A cement slurry with an initial solids loading of 61 percent was produced using 820.5 g of deionized water, and 90.5 g of colloidal silica. Typical suitable colloidal silicas include Remet LP30, Remet SP30, Nalco 1030. When the slurry was mixed to an acceptable viscosity, 1354 g of calcium hexaluminate, $CA_6$, of a size range of less than 20 microns was added to the slurry. The solids loading of the mix with the calcium hexaluminate added was 75.6%. When the slurry was mixed to an acceptable viscosity, 1472 g of alumina bubble of a size range of less than 0.85 mm and greater than 0.5 mm was added to the slurry. After mixing, the investment mold mix was poured in a controlled manner into a molding vessel. The solids loading of the final mold mix was 82.6%. The mold mix poured well with satisfactory viscosity and rheology. After curing the molded part was of good strength and uniform composition.

The mold was fired at a temperature of 1000° C. for 4 hours. The final mold composition without the water contained 32.2% blended calcium aluminate cement, 32.2% calcium hexaluminate, and 35% alumina bubble with 0.6% silica. The mold possessed reduced free alumina activity from those taught by the conventional art.

In a second example, a slurry mixture for making an investment mold consisted of 677 g of a commercially blended 80% calcium aluminate cement. A cement slurry with an initial solids loading of 44.3% was produced using 820.5 g of deionized water, and 90.5 g of colloidal silica. When the slurry was mixed to an acceptable viscosity, 2031 g of calcium hexaluminate, of a size range of less than 20 microns was added to the slurry. The solids loading of the mix with the calcium hexaluminate added was 75.6%. The mix of calcium aluminate cement and calcium hexaluminate was difficult to mix and the viscosity became too high as a result of hydraulic bond formation during mixing. This mix formulation was not suitable for making a mold.

In a third example, a slurry mixture for making an investment mold consisted of 1015.5 g of a commercially blended 80% calcium aluminate cement. A cement slurry with an initial solids loading of 56.0% was produced using 820.5 g of deionized water, and 90.5 g of colloidal silica. When the slurry was mixed to an acceptable viscosity, 1692.5 g of calcium hexaluminate of a size range of less than 20 microns, was added to the slurry. The solids loading of the mix with the calcium hexaluminate added was 75.6%. When the slurry was mixed to an acceptable viscosity, 1472 g of alumina bubble of a size range of less than 0.85 mm and greater than 0.5 mm was added to the slurry. After mixing, the investment mold mix was poured in a controlled manner into a vessel. The solids loading of the final mold mix was 82.6%. The mix quality was acceptable for making a mold, although the final mix viscosity was slightly higher than preferred. In certain examples, the preferred value is less than approximately 2000 centipoise.

The mold was fired at a temperature of 1000° C. for 4 hours. The final mold composition without the water contained 24.1% blended calcium aluminate cement, 40.3% calcium hexaluminate, and 35% free alumina bubble with 0.6% silica. The mold possessed reduced free alumina activity from those taught by the conventional art.

In a fourth example, a slurry mixture for making an investment mold consisted of 2708 g of a commercially blended 80% calcium aluminate cement. A cement slurry with an initial solids loading of 61.0% was produced using 1641 g of deionized water, and 181 g of colloidal silica. When the slurry was mixed to an acceptable viscosity, 2708 g of calcium hexaluminate was added to the slurry. The solids loading of the mix with the calcium hexaluminate added was 75.6%. When the slurry was mixed to an acceptable viscosity, 2944 g of alumina bubble of a size range of less than 0.85 mm and greater than 0.5 mm was added to the slurry. After mixing, the investment mold mix was poured in a controlled manner into a vessel. The solids loading of the final mold mix was 82.6%. The resulting mold possessed a diameter of approximately 120 mm and a length of approximately 400 mm.

The mold was fired at a temperature of 1000° C. for 4 hours. The final mold composition without the water contained 32.2% blended calcium aluminate cement, 32.2% calcium hexaluminate, and 35% alumina bubble with 0.6% silica. The mold possessed reduced free alumina activity from those taught by the conventional art. The mold possessed an intrinsic facecoat that contained calcium hexaluminate.

The mold possessed an intrinsic facecoat that consisted of calcium aluminate phases and calcium hexaluminate, and the facecoat thickness was approximately 100 microns. The mold that was so produced was used successfully for casting titanium aluminide turbine blades with a good surface finish; the Ra was less than 100, and with an oxygen content of less than 2000 ppm.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments without departing from their scope. While the dimensions and types of materials described herein are intended to define the parameters of the various embodiments, they are by no means limiting and are merely exemplary. Many other embodiments will be apparent to those of skill in the art upon reviewing the above description. The scope of the various embodiments should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure. It is to be understood that not necessarily all such objects or advantages described above may be achieved in accordance with any particular embodiment. Thus, for example, those skilled in the art will recognize that the systems and techniques described herein may be embodied or carried out in a manner that achieves or optimizes one advantage or group of advantages as taught herein without necessarily achieving other objects or advantages as may be taught or suggested herein.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the disclosure may include only some of the described embodiments. Accordingly, the invention is not to be seen as limited by the foregoing description, but is only limited by the scope of the appended claims.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A mold for casting a titanium-containing article, comprising:

a bulk comprising calcium hexaluminate and a calcium aluminate cement, said calcium aluminate cement comprising calcium monoaluminate, calcium dialuminate, and mayenite;

a cavity for casting the titanium-containing article therein; and an intrinsic facecoat of thickness about 10 microns to about 500 microns disposed between the bulk and the cavity, wherein said intrinsic facecoat comprises calcium hexaluminate and a calcium aluminate cement, said calcium aluminate cement comprising calcium monoaluminate, calcium dialuminate, and mavenite.

2. The mold as recited in claim 1, wherein said calcium hexaluminate comprises particles that are less than about 50 microns in outside dimension.

3. The mold as recited in claim 1, wherein said calcium hexaluminate comprises from about 15 percent by weight to about 50 percent by weight of the mold.

4. The mold as recited in claim 1, wherein the intrinsic facecoat is a continuous intrinsic facecoat or a non-continuous intrinsic facecoat.

5. The mold as recited in claim 1, wherein the bulk and the intrinsic facecoat have different compositions, and wherein the intrinsic facecoat comprises calcium aluminate cement with a particle size of less than about 50 microns.

6. The mold as recited in claim 1, wherein the bulk and the intrinsic facecoat have different compositions, and wherein the bulk comprises alumina particles larger than about 50 microns.

7. The mold as recited in claim 1, wherein the bulk comprises alumina particles larger than about 50 microns and the intrinsic facecoat comprises calcium aluminate cement particles less than about 50 microns in size.

8. The mold as recited in claim 1, wherein the intrinsic facecoat has, by weight fraction, at least 20 percent more calcium monoaluminate than does the bulk.

9. The mold as recited in claim 1, wherein the intrinsic facecoat has, by weight fraction, at least 20 percent less alumina than does the bulk.

10. The mold as recited in claim 1, wherein the intrinsic facecoat has, by weight fraction, at least 20 percent more calcium monoaluminate, at least 20 percent less alumina, and at least 50 percent less mayenite than does the bulk of the mold.

11. The mold as recited in claim 1, wherein said calcium monoaluminate in the bulk comprises a weight fraction of about 0.05 to 0.95, and said calcium monoaluminate in the intrinsic facecoat comprises a weight fraction of about 0.30 to 0.95.

12. The mold as recited in claim 1, wherein said calcium dialuminate in the bulk comprises a weight fraction of about 0.05 to about 0.80, and said calcium dialuminate in the intrinsic facecoat comprises a weight fraction of about 0.05 to 0.30.

13. The mold as recited in claim 1, wherein said mayenite in the bulk comprises a weight fraction of about 0.01 to about 0.30, and said mayenite in the intrinsic facecoat comprises a weight fraction of about 0.01 to 0.05.

14. The mold as recited in claim 1, wherein said calcium monoaluminate in the bulk comprises a weight fraction of about 0.05 to about 0.95, and said calcium monoaluminate in the intrinsic facecoat comprises a weight fraction of about 0.3 to about 0.95;

wherein said calcium dialuminate in the bulk comprises a weight fraction of about 0.05 to about 0.80, and said calcium dialuminate in the intrinsic facecoat comprises a weight fraction of about 0.05 to about 0.30; and wherein said mayenite in the bulk comprises a weight fraction of about 0.01 to about 0.30, and said mayenite in the intrinsic facecoat comprises a weight fraction of about 0.01 to about 0.05.

15. The mold as recited in claim 1 further comprising:

aluminum oxide particles in the bulk that are less than about 500 microns in outside dimension.

16. The mold as recited in claim 1, wherein the calcium aluminate cement comprises more than 30 percent by weight of the composition used to make the mold.

17. The mold as recited in claim 1, further comprising:

magnesium oxide particles, calcium oxide particles, zirconium oxide particles, titanium oxide particles, or compositions thereof.

18. The mold as recited in claim 1, further comprising:

hollow particles of aluminum oxide in the bulk.

19. The mold as recited in claim 17, further comprising:

more than about 10 percent by weight and less than about 50 percent by weight of calcium oxide particles.

20. The mold as recited in claim 1, further comprising silica.

21. The mold as recited in claim 1, further comprising silicates in an amount of less than about 5 weight percent.

* * * * *